United States Patent [19]

Taniyoshi et al.

[11] Patent Number: 5,072,230

[45] Date of Patent: Dec. 10, 1991

[54] MOBILE TELESCOPING WHIP ANTENNA WITH IMPEDANCE MATCHED FEED SECTIONS

[75] Inventors: Kiyoshi Taniyoshi; Toshihiko Kondo; Kazuo Takayama, all of Kobe, Japan

[73] Assignee: Fujitsu Ten Limited, Hyogo, Japan

[21] Appl. No.: 249,556

[22] Filed: Sep. 26, 1988

[30] Foreign Application Priority Data

| | | | |
|---|---|---|---|
| Sep. 30, 1987 | [JP] | Japan | 62-149952[U] |
| Sep. 30, 1987 | [JP] | Japan | 62-149953[U] |
| Dec. 8, 1987 | [JP] | Japan | 62-186605[U] |
| Jun. 2, 1988 | [JP] | Japan | 63-74175[U] |

[51] Int. Cl.[5] ..... H01Q 1/10; H01Q 1/32

[52] U.S. Cl. ..... 343/715; 343/722; 343/903

[58] Field of Search ..... 343/702, 715, 722, 900, 343/901, 903, 860

[56] References Cited

U.S. PATENT DOCUMENTS

| | | | |
|---|---|---|---|
| 4,527,168 | 7/1985 | Edwards | 343/903 |
| 4,567,487 | 1/1986 | Creaser, Jr. | 343/900 |
| 4,584,587 | 4/1986 | Ireland | 343/745 |
| 4,658,260 | 4/1987 | Myer | 343/903 |
| 4,660,049 | 4/1987 | Shinkawa | 343/715 |
| 4,675,687 | 6/1987 | Elliott | 343/903 |
| 4,712,965 | 1/1988 | Elliot | 343/903 |
| 4,734,703 | 3/1988 | Nakase et al. | 343/715 |
| 4,748,450 | 5/1988 | Hines et al. | 343/901 |
| 4,829,317 | 5/1989 | Shinkawa | 343/901 |
| 4,839,660 | 6/1989 | Hadzoglou | 343/715 |

FOREIGN PATENT DOCUMENTS

| | | |
|---|---|---|
| 61-227405 | 10/1986 | Japan . |
| 62-173801 | 7/1987 | Japan . |
| 62-179202 | 8/1987 | Japan . |

*Primary Examiner*—Michael C. Wimer

*Attorney, Agent, or Firm*—Wenderoth, Lind & Ponack

[57] ABSTRACT

An antenna element including a loading coil is telescopically extendable and retractable from within a housing tube. A characteristic impedance of a transmission line from a lower end part of the antenna element to a cable is equal to one of a cable. A part of the loading coil is reinforced. A branching filter, which is operatively connected between the antenna and a communication device using a different frequency band, suppresses a mutual interference between signals for the communication device. An antenna circuit, which is operatively connected between the antenna or a branching filter and the communication device, converts an impedance of a lower part in a frequency band, and reduces a loss due to a capacitive antenna impedance.

3 Claims, 15 Drawing Sheets

174
103
125
123
173
147
149
146
124
ℓ31
148
145
175
171
172
135
143
142
102
141
138
140
d1
139
ℓ32
D1
137
127
126
A
128a
128
A
128b
136
D1a
ℓ33
B
B
120
120a
120b
106
176
133
132
105
d1a
134
130
P
129
109
107

MOBILE TELESCOPING WHIP ANTENNA WITH IMPEDANCE MATCHED FEED SECTIONS

BACKGROUND OF THE INVENTION

1. Field of the Invention

This invention relates to an apparatus employing a interference, signals in different frequency bands, such as mobile telephone signals and radio broadcasting, and is preferably mounted to a car.

2. Description of the Prior Art

FIG. 1 is a sectional view of a typical conventional car-mount whip antenna 1 in its extended state. This whip antenna 1 is mounted, for example, near the rear trunk of an automobile car body 2, and is used commonly for the transmission and reception of signals for a mobile telephone and the reception of radio broadcasts. An antenna element 3 of this whip antenna comprises a first antenna element part 4 having a round tubular shape, and a second antenna element part 5 formed telescopically disposed within the first antenna element part 4. The antenna element 3 is accommodated in a housing tube 6 fitted in a mounting hole 14 formed in the car body 2. The housing tube 6 is composed of a tubular body 7 made of electric insulating material such as resin, and an outer conductor 8 and an inner conductor 9 made of conductive materials.

The first antenna element part 4 is composed of a sequential connection of a first conductor 15, a phase shifting coil 18, a second conductor 16;, a band separating coil 19, and a third conductor 17. These conductors 15 to 17 and coils 18 and 19 have identical outside diameters. The phase shifting coil 18 functions as a phase shifter on frequency f1 of a mobile telephone, so that the current distribution in reverse phase may be suppressed low, while the normal phase portion is emphasized in the current distribution profile. The band separating coil 19 has a high impedance against frequency f1 of the mobile telephone, and a low impedance against frequency f2 of a radio broadcast.

Therefore, a colinear array antenna is constituted by conductors 15 and 16 an the phase shifting coil 18, which may be used for the transmission and reception of mobile telephone signals. The overall length of the antenna element 3 is used in the reception of radio broadcasts.

A leaf spring 28 is fixed at a lower end part 15*a* of the antenna element 3. And, by this leaf spring 28 the antenna element 3 is supported so as to be slidable in the axial direction, while it is electrically connected with the inner conductor 9. At an upper end part 6*a* of the housing tube 6, the outer conductor 8 is fixed to the car body 2 by way of metallic fixing tubes 21 and 22 and fixing plate 23, and hereby connected electrically. The connections of the housing tube 6, fixing tubes 21, 22 and the fixing plate 23 are filled with sealing resin 24, and a nut 25 is screwed thereover.

Beneath the housing tube 6, a connection hole 26 is formed near the lower end part 9*a* of the inner conductor 9. In the connection hole 26, an inner conductor 12 of a coaxial cable 11 is connected to the inner conductor 9, and an outer conductor 13 of the coaxial cable 11 is connected to the outer conductor 8. The coaxial cable 11 is supported by a cable support member 30 fitted to the outer conductor 8. This coaxial cable 11 is connected to a branching filter 27, and this branching filter 27 is connected to the transmitter/receptor of the mobile telephone and the radio set by the coaxial cable 29*a* and 29*b*.

This whip antenna 1 is erected, for example, near the rear trunk of the car body 2. Therefore, there are a large number of restrictions imposed due to the shape of the car body 2, such as, on the width of the rear fender and the size of the mounting hole 14 for mounting the housing tube 6. Besides, if the outer diameter of the antenna element 3 is reduced too much in order to resist the wind pressure while traveling, the tubular body 7 made of electric insulation material becomes thin, and the spacing between the inner conductor 9 and the outer conductor 8 becomes small.

Therefore, as mentioned below, the characteristic impedance Z2 from the upper end part of the housing tube 6 to the lower end part 9*a* of the inner conductor 9, that is, in the section l2 up to the current feed point P is lowered. On the other hand, if the mobile telephone is used in a state in which the impedance at the current feed point P is mismatched, the signal sent out from the transmitter is reflected, so that the coil in the transmitter may be burnt.

Therefore, by forming the length of this section l2 at about 15 cm or half of the wavelength λ1 of the mobile telephone, the impedance matching is achieved. Therefore, the current feed point P cannot be set at an arbitrary position. Such construction of the whip antenna 1 in accordance with the above-mentioned length restriction causes the following problems.

FIG. 2 is an equivalent circuit diagram in which the whip antenna 1 is used for the reception of frequency modulated (FM) broadcasts. In this antenna element 3, supposing the characteristic impedance of the section l1 projecting from the upper end part 6*a* of the housing tube 6 to be Z1, and the characteristic impedance of the section l3 of the coaxial cable 11 to be Z3, the characteristic impedance Z1 of section l1 is nearly equal to the characteristic impedance Z3 of section l3, and is, for example, about 50 ohms. Moreover, the characteristic impedance Z2 of the section L2 is expressed as follows, assuming the outside diameter of the inner conductor 9 to be d, the inside diameter of the outer conductor 8 to be D and the specific dielectric constant of the tubular body 7 to be εr:

$$Z2 = \frac{138}{\sqrt{\epsilon r}} \log_{10} \frac{D}{d} \ [\Omega] \qquad (1)$$

On the other hand, because of the restrictions by imposed the shape of the car body 2 as mentioned above, there is not a large difference between the outside diameter d of the inner conductor 9 and the inside diameter of the outer conductor 8, and therefore as is clear from eq. (1), the characteristic impedance Z2 in the section l2 is lowered, and the impedance matching between the section l1 or antenna element 3 and the section 13 or the coaxial cable 11 is worsened, whereby transmission loss increases. Accordingly, the length of the section l2 becomes too long to be ignored with respect to the wavelength λ2 of FM broadcast, and the band width is consequently narrowed.

FIG. 3 is an equivalent circuit diagram in which the whip antenna 1 is used for the reception of amplitude-modulated (AM) broadcasts. The length of the antenna element 3 is formed in accordance with the mobile telephone and FM broadcast, so that it is extremely short for the wavelength of AM broadcasts, and the radiation resistance almost becomes null, and the characteristic impedance Z1 becomes capacitative.

Supposing the capacity of section l1 to be C1;, that of section l2 to be C2, and that of section l3 to be C3, the relation between a voltage V1 induced in the antenna element 3 and a voltage V2 at the power receiving end obtained by way of coaxial cable 11 is set forth in the following equation:

$$V2 = \frac{C1}{C1 + C2 + C3} \cdot V1 \quad (2)$$

where the capacitance C1 of section l1 and the capacity C3 of section l3 are constant, and the power receiving end voltage V2 may be raised by reducing the capacity C2 of section l2. However, the capacity C2 of section l2 is, supposing the specific dielectric constant in a vacuum to be $\epsilon_0$, expressed as follows $$C2 = \frac{2\pi\epsilon_0\epsilon r}{\log_e \frac{D/2}{d/2}} \cdot l2[F] \quad (3)$$

and the ratio of the inside diameter D of the outer conductor 8 to the outside diameter d of the inner conductor 9 cannot be increased too much as stated above, and therefore the power receiving end voltage V2 cannot be increased too much.

FIG. 4 is a sectional view of another conventional whip antenna 31 in an extended state. This long bar-shaped whip antenna 31 is mounted near the rear trunk of an automobile car body 32, and is commonly used for the reception of radio broadcasts and the transmission and reception of mobile telephone signals. An antenna element 33 of this whip antenna 31 is composed in a sequential connection of a first conductor 34, a phase shifting coil 38, a second conductor 35, a band separating coil 39, a third conductor 36, and a fourth conductor 37. The first conductor 34 and the second conductor 35 have a round cylindrical shape; and the third conductor 36 is formed like a cap.

Within a space 43 formed by the first conductor 34, the phase shifting coil 38, the second conductor 35 and the band separating coil 39, the fourth conductor 37 is accommodated. The outside diameters of the first to third conductors 34 to 36, and coils 38 and 39 are identical, and such elements are housed in a housing tube 40 provided in the car body 32.

The housing tube 40 is composed of an electric insulating tube body 40*a*, an outer conductor 40*b*, and an inner conductor 40*c*. An outer conductor 44*a* of a coaxial cable 44 is connected to the outer conductor 40*b*, and an inner conductor 454*b* of the coaxial cable 44 is connected to the inner conductor 40*c*.

At the high frequency f1 of a mobile telephone or the like, the phase shifting coil 38 functions as a phase shifter, and the normal phase portion is emphasized by suppressing the current distribution in the reverse phase, while the band separating coil 39 has a high impedance, whereby a colinear array antenna is formed by the first conductor 34, the phase shifting coil 38, and the second conductor 35 to be used for the transmission and reception of mobile telephone signals.

At the low frequency f2 of a radio broadcast or the like, the band separating coil 39 has a low impedance, and the first to fourth conductors 34 to 37 and coils 38 and 39 are used as a whip antenna for the reception of the radio broadcast.

Since the portions of coils 38 and 39 exhibit low strength, they are likely to be broken, and they are reinforced by molding resins 41 and 42 thereto. The resin portions 41 and 42 have the same outside diameters a those of first to third conductors 34 to 36 so as not to [illegible] an obstruction when the antenna element 33 is put into the housing tube 40.

In the thus composed whip antenna 31, the resin portions 41 and 42 are bulged out, inward in the radial direction of coils 38 and 39, in order to obtain a desired strength. Therefore, such bulging would interfere with the displacement of the fourth conductor 37 into the space 43, and it is difficult to provide resin portions 41, 42 with a thickness sufficient to obtain a desired strength. Besides, after the coils 38 and 39 are once molded with resins 41 and 42, it is difficult to adjust the length of the coils 38 and 39. Furthermore, since the first to third conductors 34 to 36 are metallic, thus being of material different from the resin 41 and 42, the antenna is deemed to be unaesthetic.

FIG. 5 is a block diagram of a conventional transmission/reception apparatus 50 for a mobile telephone. For mounting a mobile telephone on an automobile, the antenna provided for the reception of radio broadcasts is shared because its transmission frequency band f1 is different from the frequency band f2 of the radio broadcasts. In order to share the antenna in this way, the signal line of the mobile telephone is connected wit the signal line of the radio set. Therefore, when a radio broadcast is received while using the mobile telephone, the so-called beat noise is mixed in the sound reproduced by the radio set. To prevent the generation of such beat noise, the elements shown in FIG. 5 have been used hitherto.

The frequency band f2 of radio broadcasts is, in AM broadcasts, frequency band f2*a*, that is, 500 to 1620 kHz, and, in FM broadcasts, frequency band f2*b*, that is, 76 to 90 MHz. In the mobile telephone, on the other hand, for radio communication with the ground station connected with the telephone line, a frequency band f1*a* of 870 to 9890 MHz is used in receiving, and a frequency band f1*b* of 920 to 940 MHz is used in sending. The prior art shown in FIG. 5 makes use of such a difference in frequency band.

In other words, a radio set 51 is connected to an antenna 53 by way of a low pass filter 52, and the mobile telephone 54 is connected to the antenna 53 by way of a high pass filter 55. The signal line connected to the mobile telephone 54 is joined to the signal line connected to the radio set 51. During use of the mobile telephone 54, since the frequency band f1 of the signals transmitted or received by the mobile telephone 54 is relatively high, the radio set 51 will not generate beat noise by the interference with the signal in the frequency band f2 used in the mobile telephone 54 owing to the low pass filter 52.

The equivalent circuit of the antenna 53 and the typical circuit composition of the low pass filter 52 are shown in FIG. 6. A capacitor C11 is connected in series to a signal source 56, and coils L11 and L12 are connected in series to this capacitor C11. The contact point 57 of coils L11 and L12 is grounded by way of another capacitor C12.

The relation between voltage V11 generated in signal source 56 and output voltage V12 of the low pass filter 52 due to electrostatic capacity of capacitors C11 and C12 is as follows:

$$V12 = \frac{C11}{C11 + C12} \cdot V11 \quad (4)$$

That is, in the low pass filter 52, since the capacitor C12 is provided between the signal line and the ground, the output voltage V12 of the low pass filter 52 unfavorably becomes smaller than the generated voltage V11 in the signal source 56. In eq. 4, since it is supposed that radio broadcasts are to be received, the attenuation of signals by coils L11, L12 is assumed to be sufficiently small.

FIG. 7 is an equivalent circuit diagram in the frequency band f2*a* of AM broadcast of an antenna 61 and a cable 62 in a different prior art device.

In a car-mounted radio set, it will be very convenient if FM radio signals, AM radio signals, and mobile telephone signals can be received by one antenna. In an antenna which is extended or retracted by a motor or the like, a signal cable cannot be attached to the lower end of the antenna, and it is difficult to shorten the signal cable. Accordingly, the cable capacity of the signal cable increases, and the impedance derived from the cable capacity becomes high. In particular, in radio signals of a relatively low frequency band such as AM radio signals, the effect of cable capacity becomes larger. Therefore, in a car-mounted antenna, signals in a wide frequency band must be sent out to the radio set while suppressing the loss by the signal cable.

The antenna 61 can be represented by antenna effective capacity Ce and antenna reactive capacity Ca, and the AM radio signals received by this antenna 61 can be represented by an alternating-current power-source V21. The cable 62 can be shown as a line l11 between terminals A1 and B1, and this line l11 is grounded by way of cable capacity Cb. The signal at the terminal B1 is fed into a radio set. The voltage V22 at this terminal B1 is expressed as follows:

$$V22 = \frac{Ce}{Ce + Ca + Cb} \cdot V21 \quad (5)$$

As expressed in eq. 5, supposing that the cable capacity Cb is large, the gain of the AM radio signals of relatively low frequency received by the antenna 61 is lowered so that the cable capacity Cb makes the receiving sensitivity and the ratio of signal to noise (S/N ratio) drop.

To prevent such a drop in receiving sensitivity and S/N ratio, an amplifier is placed between the antenna 61 and the cable 62 that is, at the position of terminal A1, so that the receiving sensitivity and S/N ratio are improved. In such antenna, since active elements are used, they give rise to an increase in cost, and also involve other problems such as maintaining a circuit characteristic of suppressing only the distortion of signals at the time of input of a strong electric field. In addition, new problems may be also experienced, such as loss due to impedance conversion in the amplifier, and insufficient matching of impedance.

SUMMARY OF THE INVENTION

It is hence a primary object of this invention to present a novel, improved transmission and reception apparatus for automobiles which solves the above-discussed problems.

It is another object of this invention to present a multi-band whip antenna having relatively low transmission loss, capable of matching the impedance favorably, while conforming to restrictions imposed by the car body shape.

To achieve the above objects, in an multi-band whip antenna of the present invention, having a housing tube which is connected and fixed to a car body of an automobile, an antenna element which is disposed in the housing tube, is electrically insulated from the housing tube, and can be extended and retracted like a telescope upward from the housing tube, and a cable which is electrically connected to the lower end part of the antenna element, in a state where the antenna element is drawn upward and extended from the housing tube, the improvement comprising:

a lower end part in the housing tube has a first lower end part which is smaller in diameter than the portion of the antenna that extends above the housing tube when the antenna element is extended, and a second lower end part which is larger in diameter than the first lower end part and is disposed directly adjacent thereto beneath and coaxial to the first lower end part;

the housing tube having a first outer tube part surrounding the first lower end part by way of an electric insulation tube body when the antenna element is extended, and a second outer tube part surrounding the second lower end part by way of the electric insulation tube body, the second outer tube part being disposed adjacent the first outer tube part and having a larger inside diameter than the first outer tube part; whereby the characteristic impedance due to the first lower end part and the first outer tube part, the characteristic impedance due to the second lower end part and the second outer tube part, and the characteristic impedance of the cable connected to the antenna element and the second lower end part are equal to each other.

According to this invention, the antenna element is stored in the housing tube which is connected and fixed to the car body of an automobile. The antenna element and housing tube are electrically insulated, and the antenna element is telescopically extendable and retractible from within the housing tube. When the antenna element is drawn out and stretched upward from the housing tube, its lower part is electrically connected with the cable.

In the extended state of antenna element, the lower end part in the housing tube has a first lower end part which is smaller in diameter than the portion of the antenna element projecting from the housing tube, and a second lower end part which is directly adjacent the first lower end part and is larger in diameter than the first lower end part. The housing tube has a first outer tube part surrounding the first lower end part by way of an electric insulation tube body, and a second outer tube part surrounding the second lower end part by way of the electric insulation tube body, the second outer tube part being disposed adjacent the first outer tube part and having a larger inside diameter than the first outer tube part.

The outside diameter of the first lower end part and inside diameter of the first outer tube part, and the outside diameter of the second lower end part and inside diameter of the second outer tube part are selected so that the characteristic impedance due to the first lower end part and first outer tube part, the characteristic impedance due to the second lower end part and second outer tube part, and the characteristic impedance due to the antenna element and cable may be nearly equal to each other.

Thus, according to this invention, if the antenna element is used for the transmission and reception of mobile telephone signals and for the reception of FM broadcasting, the impedance matching of antenna element and cable may be achieved favorably, and transmission loss may be reduced. Or, for example, when this antenna element is used for the reception of AM broadcasts, the capacity of the above portion may be reduced, sot hat the voltage at the electric power receiving end may be raised. Moreover, the antenna can accommodate for restrictions imposed thereon due to the car body shape.

In a preferred embodiment, an insertion hole places the first and second lower end parts in communication, and a wire for driving the antenna element is set in this insertion hole.

In another preferred embodiment, a brush touches a contact piece connected to the cable and installed in the housing tube when the antenna element is extended, and supports the antenna element in the second lower end part while sliding on the inner wall of the housing tube during the extension and retraction of the antenna element.

In a different preferred embodiment, the first lower end part is covered at the outer circumference thereof with electric insulation material so as to be nearly equal to the inside diameter of the housing tube.

In other preferred embodiment, the upper end part of the housing tube is arranged to be level with or lower than the lower end part of the antenna element when the antenna element is in the extended state.

In another preferred embodiment, the housing tube comprises a tubular inner conductor electrically connected to the lower end part of the antenna element, and a tubular outer conductor accommodating this inner conductor by way of a space defined therebetween.

According to this invention, the housing tube for accommodating the antenna element comprises the tubular inner conductor and outer conductor, and the antenna element is stored in the inner conductor. The antenna element is electrically connected with the cable by way of this inner conductor. The outside diameter of the inner conductor and the inside diameter of the outer conductor are selected so that the characteristic impedance due to the transmission line of the inner conductor and outer conductor, and the characteristic impedance due to the antenna element and cable may be nearly equal to each other.

Thus, according to this invention, since the space between the inner conductor and outer conductor has a small specific inductive capacity $\epsilon r$, the characteristic impedance of the transmission line of the inner conductor and outer conductor, and the characteristic impedance of the antenna element and cable may be equalized, so that impedance matching may be effected favorably. Besides, it is not necessary to increase the outside diameter of the outer conductor too much, and thus the antenna may accommodate for restrictions imposed thereon due to the car body shape.

In a certain preferred embodiment, the outer conductor is fitted to the car body, and an electric insulating support member is disposed in the space so as to support the inner conductor.

It is a further object of this invention to present a multi-band whip antenna exhibiting sufficient strength and an aesthetic appearance.

To achieve the above object, the multi-band whip antenna of this invention comprises an antenna element including a first antenna element part having a tubular conductor and a coil for operatively electrically connecting the tubular conductor in the antenna, and a second antenna element part telescopically extendable in the first antenna element part; and a covering tube made of an electric insulation material for covering the first antenna element part along its axial direction.

The antenna element of this invention comprises a first antenna element part having a tubular conductor and a coil for operatively electrically connecting this conductor in the antenna in the axial direction to be mounted on the car body, and a second antenna element part which is telescopically formed within this first antenna element part. The first antenna element part is covered with a covering tube made of an electric insulation material along its axial direction.

Thus, according to this invention, the first antenna element part having the coil exhibiting a small amount of strength is reinforced by the covering tube. And, a risk of breakage thereof may be eliminated, and deflection or deformation hardly occurs, so that stable transmission and reception may be realized. Further, the first antenna element part is covered with a homogeneous covering tube, and has an aesthetic appearance.

In a further preferred embodiment, the antenna element comprises the first antenna element part extending from the lower end part and the second antenna element part which can be stowed in this first antenna element part, the first antenna element part having plural tubular parts composed telescopically.

In another preferred embodiment, the first antenna element part is composed of two tubular parts which are extendable and retractable telescopically.

In a different preferred embodiment, an end of the wire is fixed at the lower end part of the second antenna element part, and another end of this wire is wound on a take-up shaft of a motor. The motor is driven to extend and retract the antenna element telescopically.

It is other object of this invention to provide a branching filter capable of suppressing the mutual interference of signals between plural communication means using different frequency bands.

To achieve this object, a branching filter of this invention comprises:

a first communication means for transmitting at least in a first frequency band f1;

a second communication means for receiving at least in a second frequency band f2 which is different from the first frequency band f1; and a band inhibiting means possessing an electrostatic capacity which has a larger impedance in the first frequency band f1 and is connected in series to the signal line of the second communication means.

The branching filter of this invention has the signal line from the communication means for facilitating the transmission or reception of signals at least in the first or second frequency band f1, f2 connected to a common antenna.

The signal line of the second communication means is provided with band inhibiting means having an electrostatic capacity in series with the signal line and having larger impedance in the first frequency band f1. Therefore, electrostatic capacity does not intervene occur between the signal line of the second communication means and the ground, and the signal level will not be reduced by the band inhibiting means. Besides, the signal in the first frequency band f1 at least transmitted by the first communication means is inhibited by the band inhibiting means, so that there is no adverse effect on the reception of signals by the second communication means.

Thus, according to this invention, the effect of the transmission signal of the first communication means on the reception signal of the second communication means can be suppressed without lowering the level of reception by the second communication means, and mutual interference between the transmission and reception signals of the antenna commonly used in different frequency bands f1, f2 can be suppressed.

In a further different preferred embodiment, the band inhibiting means in a parallel resonance circuit connected to the signal line, and its resonance frequency is selected in the first frequency band f1.

In another preferred embodiment, the first communication means transmits and receives signals for a mobile telephone, while the second communication means is a radio set for receiving signals in the frequency band f2 lower than the frequency band f1 of the first communication means, and the band inhibiting means is designed to inhibit signal within the transmission and reception frequency band f1 of the first communication means.

In a further preferred embodiment, the band inhibiting means is a series connection of parallel resonance circuits for resonating in the reception frequency band f1*a* and the transmission frequency band f1*b* of the first communication means.

In another preferred embodiment, a bypass filter for allowing signals in the first frequency band f1 to pass and blocking signals in the second frequency band f2 is provided in the signal line connecting the first communication means and the antenna.

It is a still different object of the present invention to provided an antenna circuit capable of enhancing the reception sensitivity and S/N ratio in a wide frequency band.

To achieve the above object, in an antenna circuit according to the present invention which is provided between the antenna and an antenna input circuit of a radio set for receiving a first radio signal in a first frequency band f2*a* and a second radio signal in a second frequency band f2*b* which is a higher frequency band than the first frequency band f2*a*, the improvement comprising:

a signal cable;

a first impedance conversion circuit connected between the signal cable and the antenna for converting the impedance in the first frequency band f2*a* from high impedance to low impedance;

a first filter circuit connected between the signal cable and the antenna for allowing signals in the second frequency band to pass f2*b*;

a second impedance conversion circuit connected between the signal cable and the antenna input circuit for converting the impedance in the first frequency band f2*a* from low impedance to high impedance; and a second filter circuit connected between the signal cable and the antenna input circuit for allowing signals in the second frequency band f2*b* to pass.

According to this invention, between the antenna and the signal cable is disposed means for adjusting the impedance, said means being composed of a first filter circuit for allowing the first radio signals in the first frequency band f2*a* to pass and a first impedance conversion circuit for converting the impedance in the second frequency band f2*b* from high impedance to low impedance. And between the signal cable and the antenna input circuit of the radio set is disposed means for adjusting the impedance, said means being composed of a second filter circuit for allowing the second radio signals in the second frequency band f2*b* to pass, and a second impedance conversion circuit for converting the impedance in the first frequency band from low impedance to high impedance.

The second radio signals are sent out to the radio from the antenna by way of the first filter circuit, while the first radio signals are converted with respect to impedance by the first impedance conversion circuit. Thus, loss due to the cable capacity in the signal cable is reduced, and the signal is transmitted to the radio set. The second radio signals are then transmitted to the antenna input circuit of the radio set through the second filter circuit, while the first radio signals are converted into an impedance matched with the antenna input circuit of the radio set by the second impedance conversion circuit, and are transmitted to the antenna input circuit of the radio set. Therefore, radio signals over a wide frequency band can be transmitted to the radio set without increasing loss in the antenna and signal cable.

In this way, according to this invention, when radio signals are received by the antenna, the loss of reception signals due to capacitative impedance of the signal cable may be reduced. Therefore, the reception sensitivity and S/N ratio in a wide frequency band can be outstandingly enhanced.

In a preferred embodiment, the first and second filter circuits are series circuits of a coil and a capacitor.

In a different preferred embodiment, the first and second impedance conversion circuits are transformers.

In a still further preferred embodiment, at least one of the primary and secondary windings of the transformer is connected in series with a coil for reducing the loss due to the stray capacity of the transformer.

BRIEF DESCRIPTION OF THE DRAWINGS

These and other objects of this invention, as well as the features and advantages thereof, will be understood and appreciated more clearly from the following detailed description in conjunction with the accompanying drawings, in which.

DETAILED DESCRIPTION OF THE PREFERRED EMBODIMENTS

Figure 1:
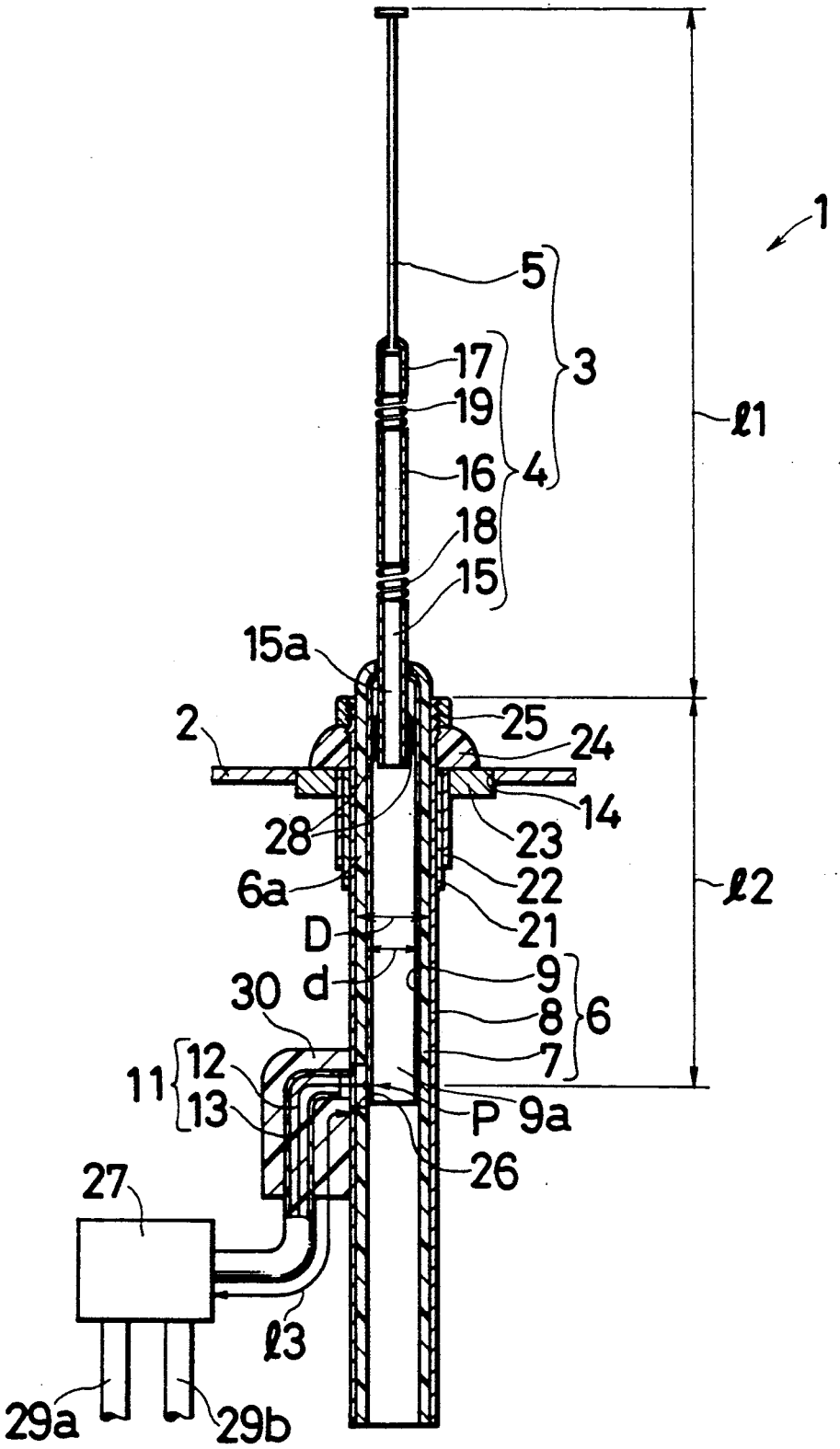
Fig. 1 Prior Art
FIG. 1 is a longitudinal sectional view of a conventional whip antenna 1 in an extended state.
Figure 2:
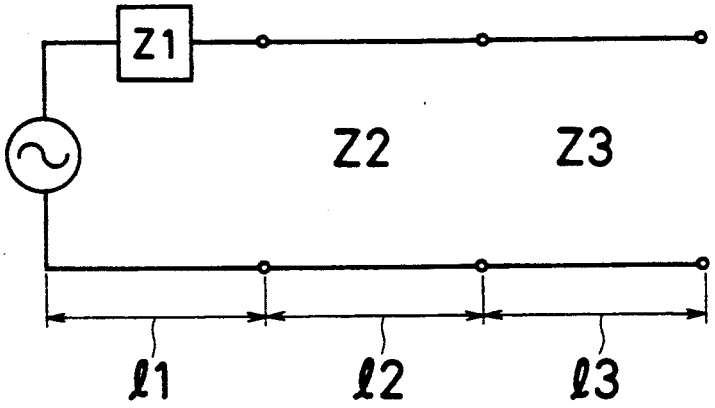
Fig. 2 Prior Art
FIG. 2 is an equivalent circuit diagram in which whip antenna 1 is used for the reception of frequency-modulated broadcasts.
Figure 3:
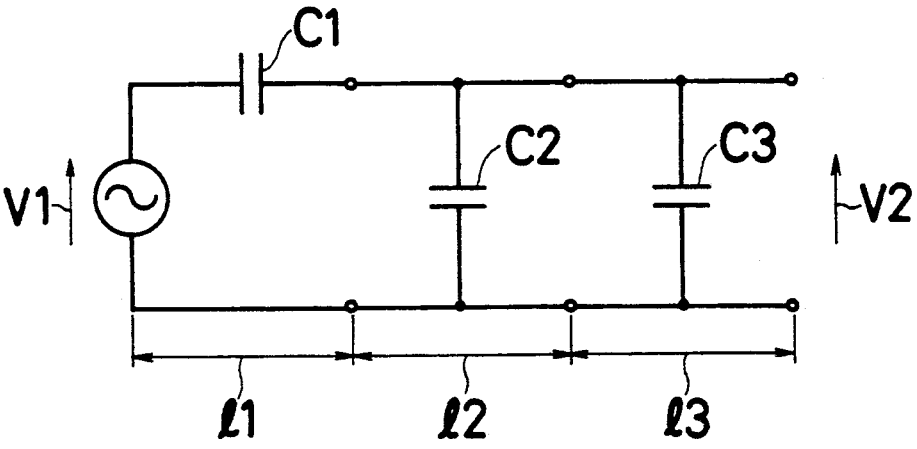
Fig. 3 Prior Art
FIG. 3 is a equivalent circuit diagram in which whip antenna 1 is used for the reception of amplitude-modulated broadcasts.
Figure 4:
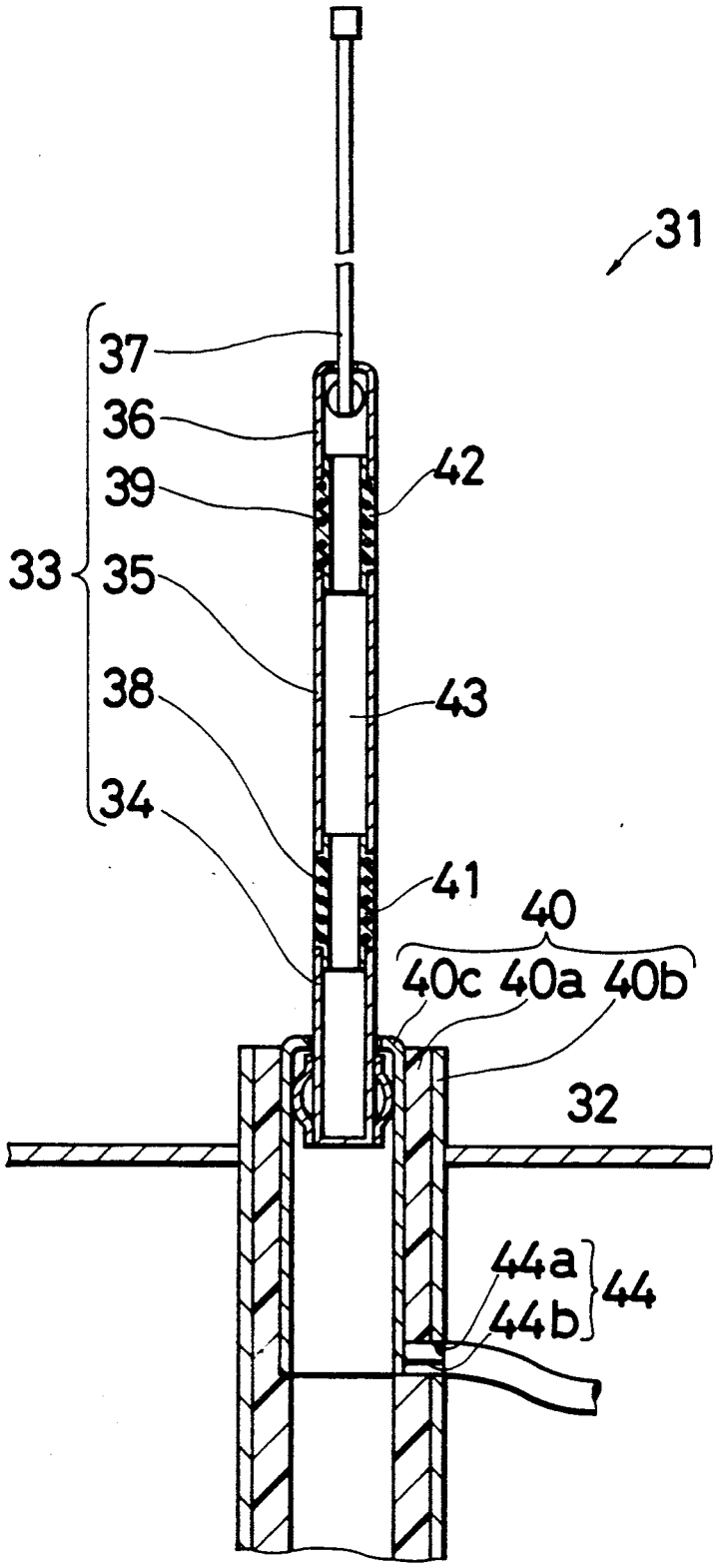
Fig.4 Prior Art
FIG. 4 is a longitudinal sectional view of another conventional whip antenna 31 in an extended state.
Figure 5:
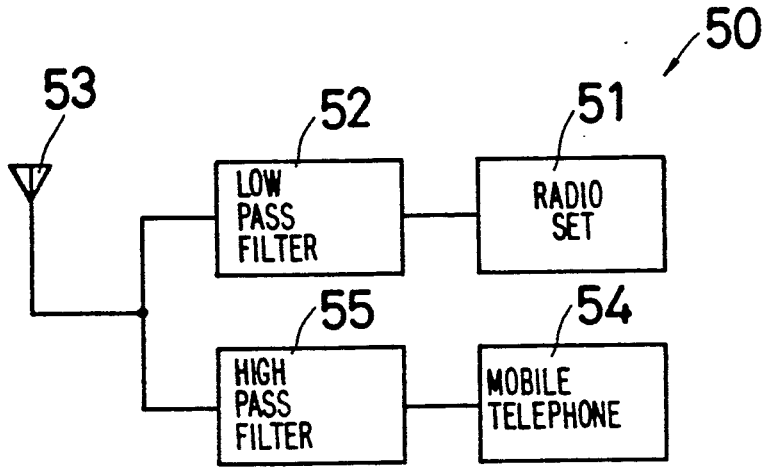
Fig. 5 Prior Art
FIG. 5 is a block diagram of a conventional transmission and reception apparatus.
Figure 6:
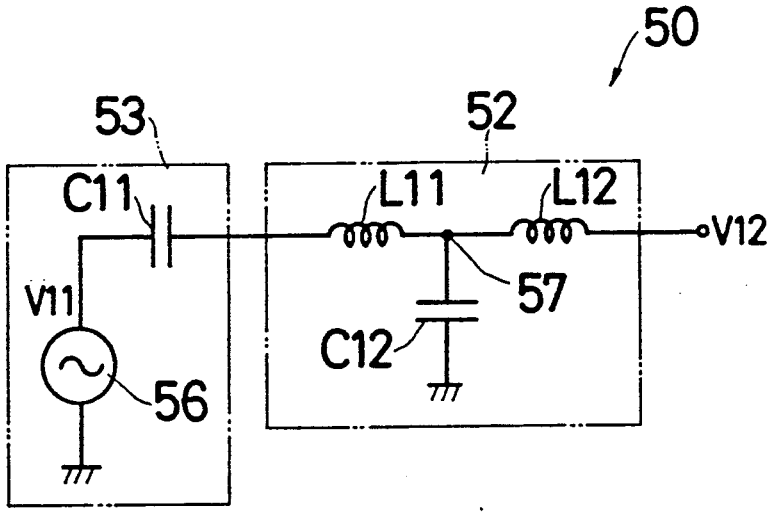
Fig. 6 Prior Art
FIG. 6 is an electric circuit diagram showing the equivalent of an antenna 53 and a low pass filter 52 of a transmission and reception apparatus 50.

Referring now to the drawings, preferred embodiments of this invention are described in detail below.

Figure 8:
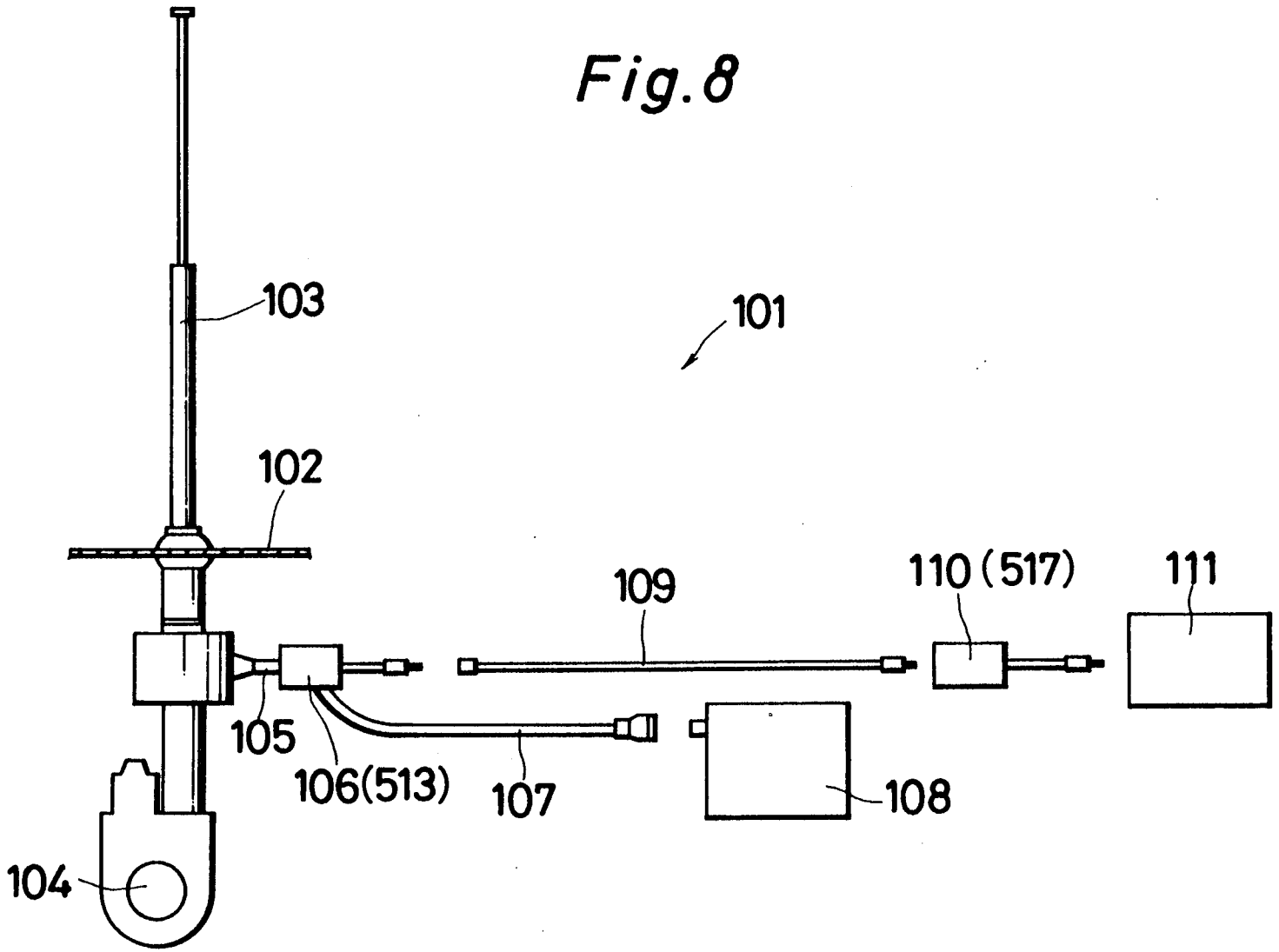
FIG. 8 is an overall schematic of a mobile transmission and reception apparatus according to the present invention.

FIG. 8 is an overall schematic of a mobile transmission and reception apparatus 101 according to the present invention.

On an automobile car body 102 is erected a multi-band whip antenna 103 which is used commonly for the transmission and reception of signals for a mobile telephone and for the reception of radio broadcasts. This antenna 103 is telescopically driven by a motor 104 installed at its lower end. The antenna 103 is connected to a branching filter 106 by way of a coaxial cable 105, and signals for the mobile telephone are transmitted or received by a mobile telephone transmitter/receiver 108 by way of a coaxial cable 107, while the reception signals of a radio broadcast are transmitted to a radio set 111 by a coaxial cable 109 through an antenna circuit 110.

Figure 9:
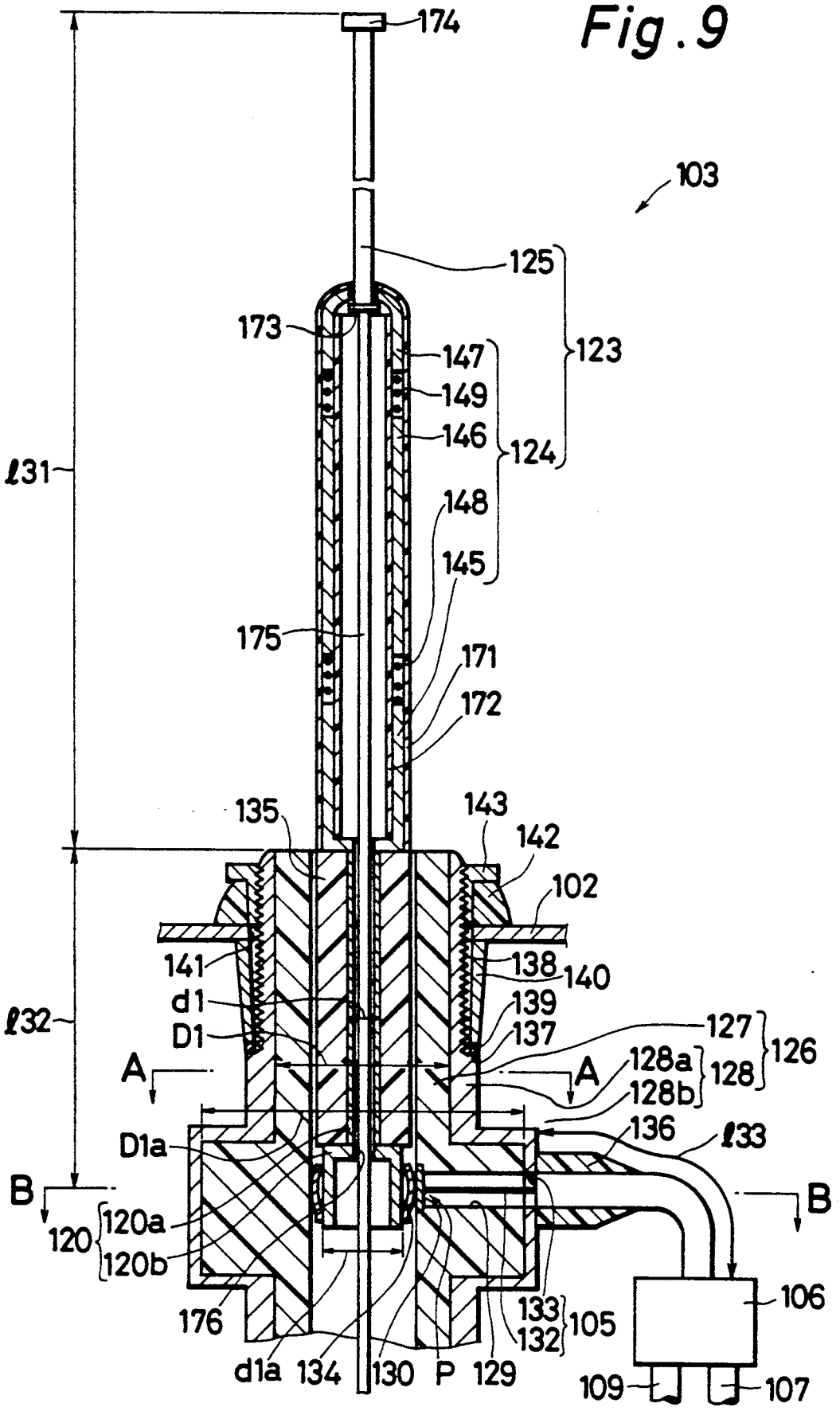
FIG. 9 si a sectional view of one embodiment of a multi-band whip antenna according to the present invention as shown in an extended state.
Figure 10:
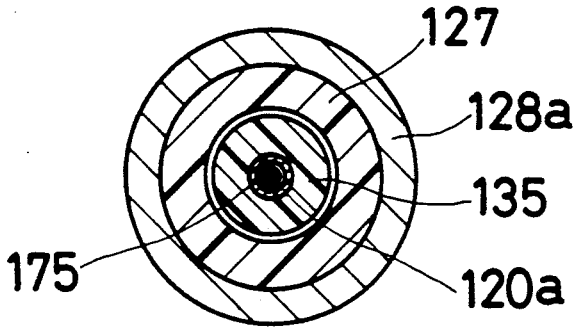
FIG. 10 is a sectional view taken along line A—A in FIG. 9.
Figure 11:
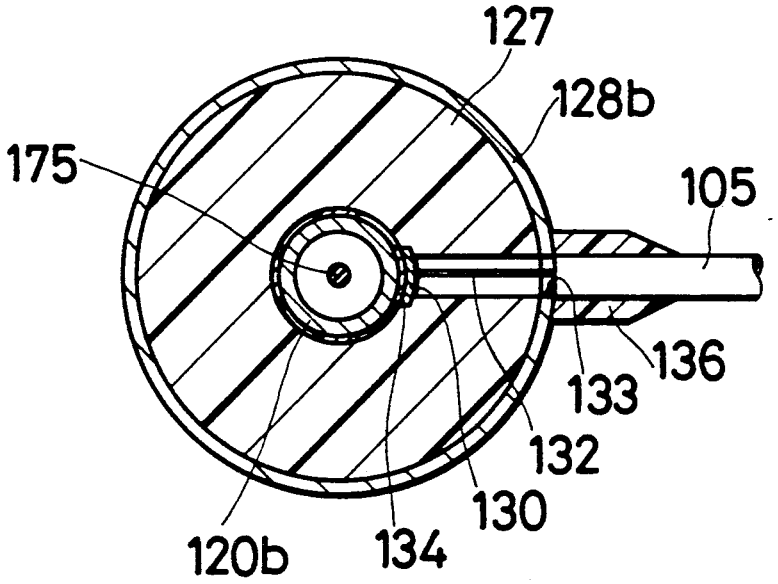
FIG. 11 is a sectional view taken along line B—B in FIG. 9.

FIG. 9 is a sectional view of one embodiment of a multi-band whip antenna according to the present invention as shown in an extended state, FIG. 10 is a sectional view taken along line A—A in FIG. 9, and FIG. 11 is a sectional view taken along line B—B in FIG. 9. This antenna 103 is set up, for example, near the rear trunk of the automobile car body 102. An antenna element 123 of this antenna 103 is composed of a first antenna element part (hereinafter called first part) 124 having a round tubular shape, and a second antenna element part (second part) 125 telescopically formed within the first part 124. This antenna element 123, in a contracted state, is stored in a housing tube 126 disposed on the car body 102.

The first part 124 is composed in a sequential connection of a first conductor 145, a phase shifting coil 148, a second conductor 146, a band separating coil 149, and a third conductor 147. These conductors 145 to 147 and coils 148 and 149 have identical outside diameters. The outer circumference of thus formed tubular first part 124 is covered with a covering tube 171, while a tube body 172 extends at the inner circumference of the first part 124, so that the first part 124 is reinforced thereby preventing deflection or deformation of the coils 148 and 149. The covering tube 171 and the tube body 172 are made of electric insulating synthetic resin such as glass fibers which will not affect the transmission and reception characteristics of the antenna 103.

As shown in FIG. 9, in the extended state of the antenna element 123, a lower end part 120 extends directly from the first conductor 145, is positioned in the housing tube 126 and is composed of a first lower end part **120*a* having a round tubular shape with a diameter smaller than that of the first part 124, and a second lower end part 120*b* similar to a cap and having a diameter larger than that of the first lower end part 120*a*, the second lower end part 120*b* being directly beneath the first lower end part 120*a*. The outer circumference of the first lower end part 120*a* has molded thereto a resin piece 135 so as to have a diameter identical with the outside diameter of the first part 124. As a result, the antenna element 123 can be expanded and contracted smoothly. On the outer circumference of the second lower end part 120*b*, a brush 134 is mounted in order to support the antenna element 123 and slide on a contact piece 130** which is described later.

The housing tube 126 is composed of an inner tube 127 made of electric insulation material, for example, resin, and an outer tube 128 made of conductive material. The outer tube 128 comprises a first outer tube part **128*a* associated with the first lower end part 120*a*, and a second outer tube part 128*b* associated with the second lower end part 120*b***.

In the extended state of antenna element 123, a connection hole 129 is formed, extending through the second outer tube part **128*b* and inner tube 127 toward the lower end part 120*b*. And the contact piece 130 contacting the second lower end part 120*b* is fixed in this connection hole 129. To the contact piece 130 is connected an inner conductor 132 of the coaxial cable 105, and the antenna element 123 and the inner conductor 132 are electrically connected. An outer conductor 133 of the coaxial cable 105 is connected to the outer tube 128 of the housing tube 126, and this outer tube 128 is electrically connected with the car body 102 as mentioned below. Thus, the outer conductor 133 is connected to the car body 102. The vicinity of the current feed point P where the contact piece 130 is disposed is reinforced by resin 136**.

At the upper end part of the outer tube 128 of the housing tube 126, a step 137 is formed, and external threads 138 are formed upward from this step 137. At the upper end part of the housing tube 127 where external threads 138 are formed, a connecting member 140 with a metallic ring 139 is inserted. The upper end part of the housing tube 126 where the connecting member 140 is thus inserted is inserted in a mounting hole 141 formed in the car body 102, and projects from the surface of the car body 102. In the part of the housing tube 126 projecting from the surface of the car body 102, a resin-made seat 142 is fitted, and a nut 143 is set therein. The side of the connecting member 140 at the end part of the car body 102 has a sawtooth shape, and therefore the outer tube 128 is electrically connected with the car body 102, and the outer conductor 133 of the coaxial cable 105 is grounded, while the housing tube 126 is securely fitted to the car body 102.

Flanges 173 and 174 are formed at both ends of the second part 125 of the antenna element 123, so that the second part 125 is prevented from slipping out of the first part 124 or falling into the first part 124. At the flange 173 at the lower end of the second part 125, one end of a flexible wire 175 telescopically driven by the motor 104 is fixed. The other end of this wire 175 is wound on a take-up reel or the like mounted on the output shaft of the motor. The wire 175 passes through an insertion hole 176 defined at the inner circumference of the tubular first lower end part 120*a* and the cap-shaped second lower end part 120*b*, so that the antenna element 123 can be extended or retracted by the driving of the motor 104 in the normal or reverse directions, and may be stored in the housing tube 126.

The signal transmitted and received by thus composed antenna element 123 is led into the branching filter 106 from the coaxial cable 105, and the frequency band is separated. The separated signal is led into the transmitter/receiver 108 of the mobile telephone through the coaxial cable 107, and is also led into the radio set 111 from the coaxial cable 109 through the antenna circuit 110.

In the antenna element 123, supposing the wavelength of the mobile telephone to be $\lambda 1$, the first conductor 145 is formed to have a length of $3\times\lambda\frac{1}{8}$ (approx. 11 cm), while the developing length of the phase shifting coil 148 is $\lambda\frac{1}{4}$ (about 9 cm), and the length of the second conductor 146 $5\times\lambda\frac{1}{8}$ (about 20 cm). Thus, a colinear antenna array is composed by first, second conductors 145 and 146, and the phase shifting coil 148.

The overall length in the state of developing the phase shifting coil 148 of this colinear array antenna is about 40 cm, and in other words it is selected at 5/4 times the wavelength $\lambda 1$ in the frequency band 860 to 940 MHz of a mobile telephone in Japan. The phase shifting coil 148 functions as a phase shifter for the wavelength of $\lambda 1$, and suppresses the current distribution in the reverse phase at a low level, so that a current distribution possessing an amplitude largely emphasized in the normal phase portion is obtained. The band separating coil 149 has a high impedance against the short wavelength $\lambda 1$ mobile telephone signals, and a low impedance against long wavelength $\lambda 2$ radio broadcasting. Thus the, transmission and reception of mobile telephone signals can be effected by using a colinear array antenna.

The winding length of the phase shifting coil 148 is about 4 cm, and therefore the overall length of the colinear array antenna is about 35 cm. The length from the lower end part of the band separating coil 149 to the upper end part of the second part 125 is selected to be about 38 cm, and therefore the overall length of this antenna element 123 is about 73 cm. In other words, it is selected at a length of $\frac{1}{4}$ of the wavelength $\lambda 2$ in the frequency band 76 to 90 MHz of FM broadcasting in Japan. Thus, at a relatively long wavelength $\lambda 2$ of radio broadcasting, the radio broadcast is received by using the overall length of the antenna element 123.

In this whip antenna 103, supposing the section of the portion projecting from the upper end part of the housing tube 126 of the antenna element 123 to be l31, the section from the upper end part of the housing tube 126 to the current feed point P to be l32, and the section of the coaxial cable to be l33, the outside diameter d1 of the first lower end part 120*a* of the lower end part 120 may be set sufficiently smaller than the inside diameter D1 of the first outer tube part 128*a* of the outer tube 128. Besides, with respect to the outside diameter d1*a* of the second lower end part 120*b* sliding on the contact piece 130, the inside diameter D1*a* of the second outer tube part 128*b* may be formed largely. Thus, from eq. 1, the characteristic impedance Z2 in the section l32 may be increased.

Therefore, when transmitting or receiving mobile telephone signals and receiving FM broadcasts, from eq. 1, a favorable impedance matching may be obtained by properly selecting the ratio of the inside diameters D1 and D1*a* of the outer tube parts 128*a* and 128*b* to the outside diameters d1 and d1*a* of the lower end parts 120*a* and 120*b*, so that the characteristic impedance Z2 in the section l32 may be substantially equal to the characteristic impedance Z1 and Z3 in the sections l31 and l33. As a result, the transmission loss may be reduced, and the reception frequency band may be prevented from being too narrow.

Besides, when receiving AM broadcasts, as stated above, since the ratio of the inside diameters D1 and D1*a* of the outer tube parts 128*a* and 128*b* to the outside diameters d1 and d1*a* of the lower end parts 120*a* and 120*b* may be set larger, the capacity C2 in the section l32 may be reduced as indicated in eq. 3 and eq. 2, so that the power receiving end voltage V2 may be increased.

Furthermore, since the outer diameter of the first outer tube part 128*a* of the outer tube 128 will not enlarged, and since the current feed point P may be set at an arbitrary position, the present invention is not hampered by restrictions imposed by the shape of the car body 102, and thus is suitable for use in any model of automobile.

In addition, since the first part 124 of the antenna element 123 is reinforced by the covering tube 171 and the tube body 172, breakage of the antenna element 123 may be prevented, while deflection or deformation may be also avoided, so that stable transmission and reception may be realized.

Moreover, a favorable appearance is attained by covering the first part 124 comprising the coils 148 and 149 with a covering tube 171 made of a homogeneous material, and the first part 125 can be smoothly put inserted into the housing tube 126. Due to the insertion of the tube body 172, the second part 125 may be smoothly disposed in the antenna. By detaching the covering tube 171, the coils 148 and 149 are exposed, sot hat adjustment can be done easily.

Still further, by forming the lower end part 120*a* as a round cylinder and forming an insertion hole 176 in the second lower end part 120*b*, rainwater penetrating past the first part 124 may be discharged, and the impedance matching may be further enhanced.

Figure 12:
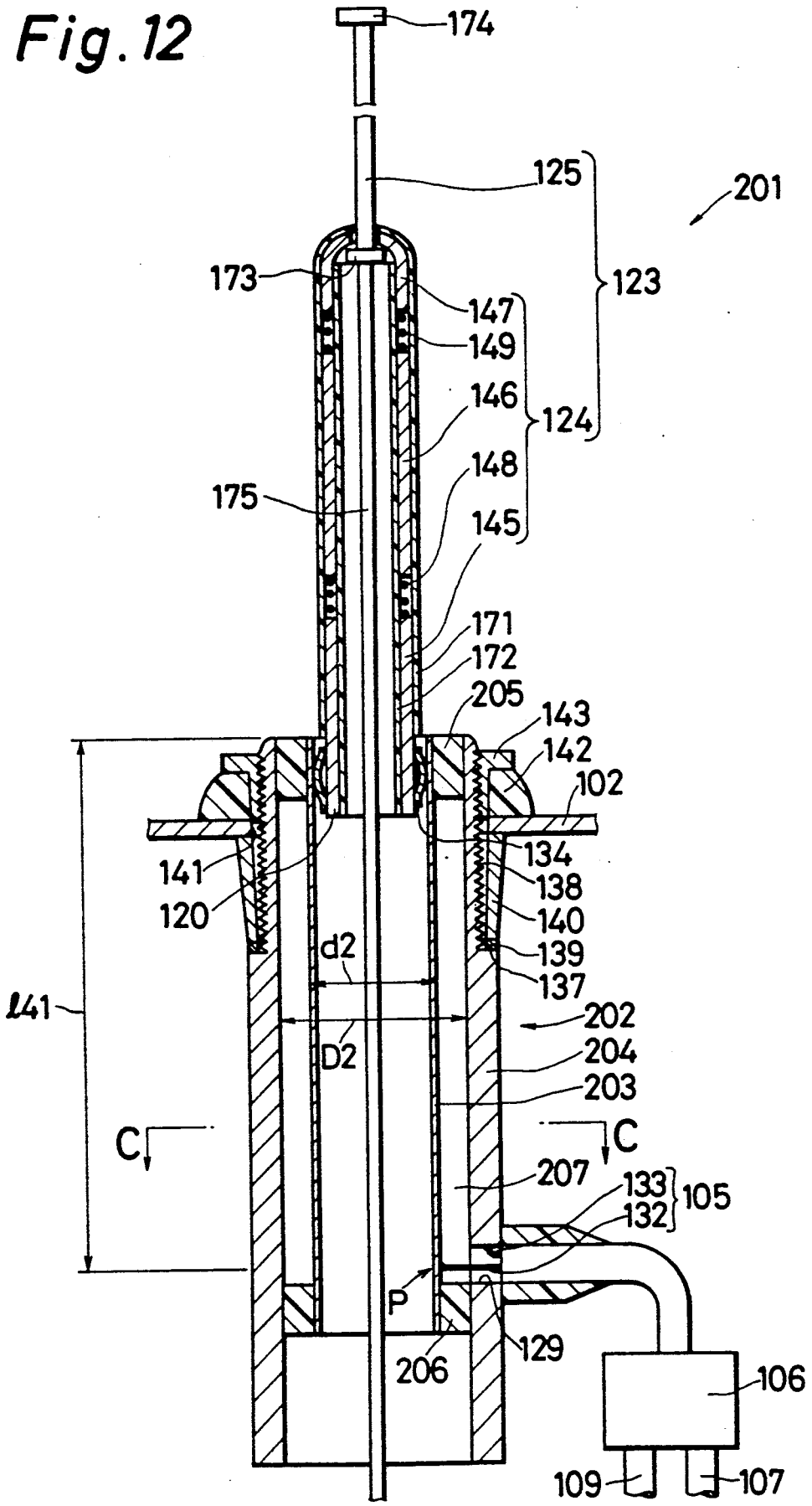
FIG. 12 is a sectional view of another embodiment of a multi-band whip antenna according to the present invention as shown in an extended state.
Figure 13:
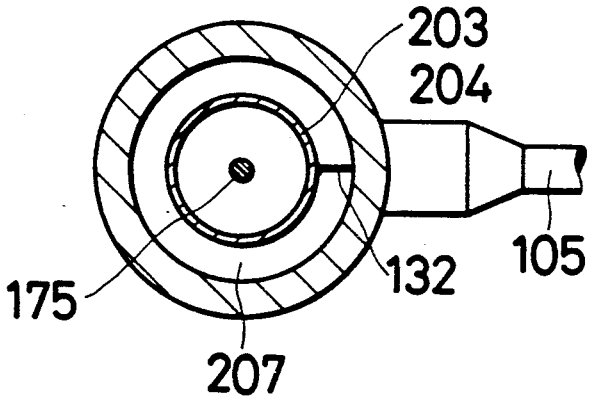
FIG. 13 is a sectional view taken along line C—C in FIG. 12.

FIG. 12 is a sectional view of another embodiment of a multi-band whip antenna 201 according to the present invention as shown in an extended state, and FIG. 13 is a sectional view taken along line C—C in FIG. 12. This embodiment is similar to the foregoing embodiment, and the corresponding parts are identified with same reference numbers.

In this embodiment, a housing tube 202 comprises an inner conductor 203 having a round cylindrical shape, an outer conductor 204 having a round cylindrical shape with a larger inside diameter D2 than an outside diameter d2 of the inner conductor 203, and support members 205 and 206 made of electric insulation material and interposed between the conductors 203 and 204 at both ends of the inner conductor 203.

A brush 134 fitted to a lower end part 120 of the antenna element 123 slides on the inner circumference of the inner conductor 203. And an inner conductor 132 of a coaxial cable 105 is connected at a current feed point P on the outer circumference of inner conductor 203. At the current feed point P, a connecting hole 129 is formed in the outer conductor 204, and in this connecting hole 129, an outer conductor 133 of the coaxial cable 105 is connected to the outer conductor 204.

Thus, in the housing tube 202, by forming a space 207 between the inner conductor 203 and outer conductor 204, the specific dielectric constant $\epsilon r$ in eq. 1 may be reduced to the value of air, that is, nearly 1.0, and the characteristic impedance Z2 in a section 141 can be increased while a capacity C2 can be reduced without enlarging the outside diameter of the housing tube 202, so that the same effects as in the foregoing embodiment may be obtained.

Figure 14:
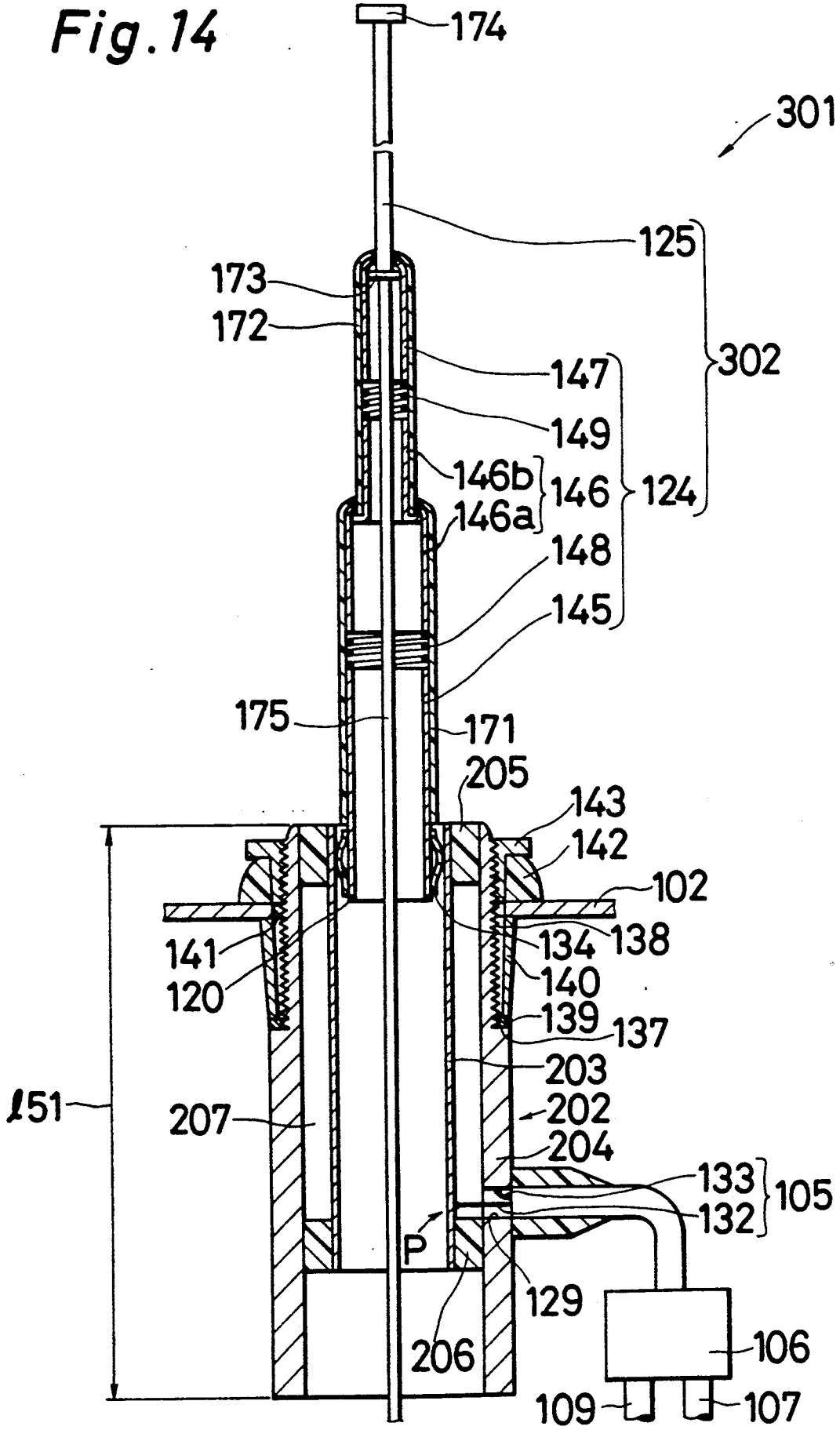
FIG. 14 is a sectional view of a further embodiment of a multi-band whip antenna according to the present invention as shown in an extended state.

FIG. 14 is a sectional view of still a further embodiment of a multi-band whip antenna 301 according to the present invention as shown in an extending state. This embodiment is similar to the foregoing embodiments, and the corresponding parts are identified with same reference numbers. In this embodiment, an antenna element 302 is composed in three stages, and a second conductor 146 interposed between a phase shifting coil 148 and a band separating coil 149 is divided into a lower conductor 146*a* and an upper conductor 146*b*. The first to fourth conductors 145, 146*a*, 146*b* and 147 and coils 148 and 149 are covered at the outer with covering tubes 171 and 172.

By thus dividing the antenna element 302 into three stages, the size of the antenna element 302 in the retracted state can be reduced, and the length of the housing tube 202 may be shortened.

Figure 15:
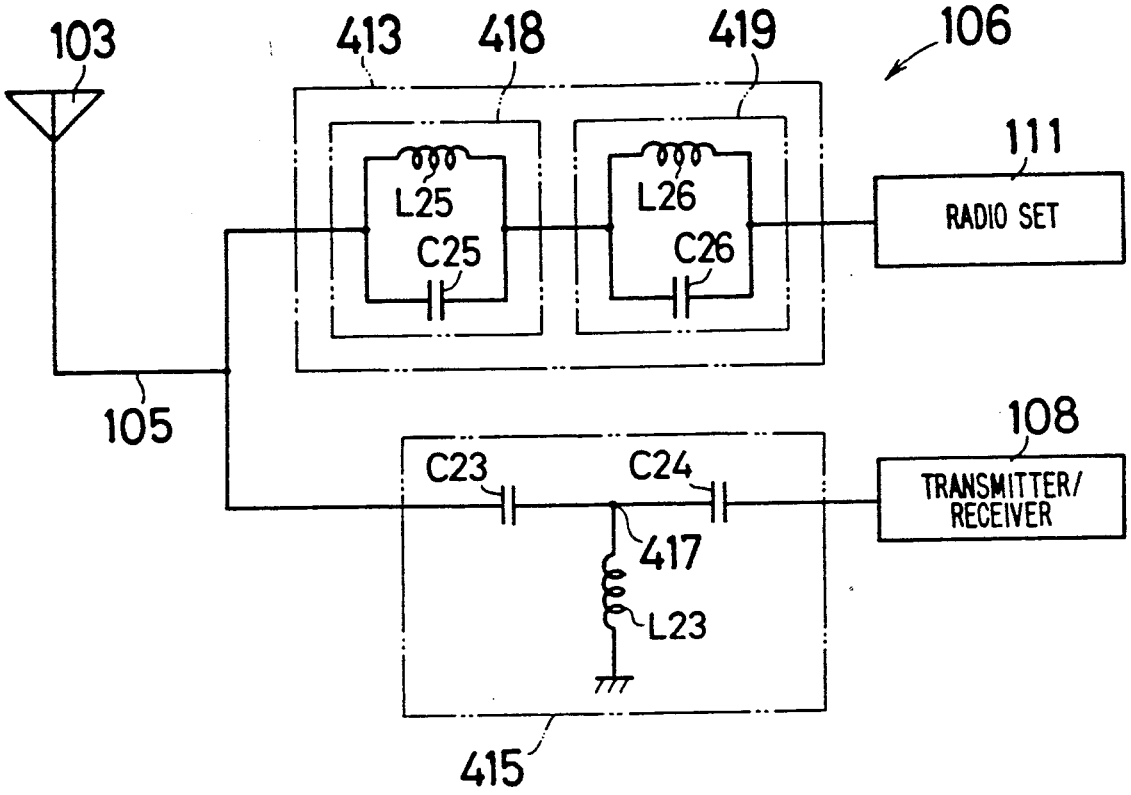
FIG. 15 is an electric circuit diagram of an embodiment of a branching filter according to the present invention.

FIG. 15 is an electric circuit diagram of a branching filter 106 in an embodiment according to the invention. The antenna 103 mounted on an automobile is connected to a band inhibiting filter 413 by way of a cable 105 which constitutes a signal line. The output of the band inhibiting filter 413 is applied to a radio set 111 which constitutes second communication means. The coaxial cable 105 is connected with a transmitter/-receiver 108 of a mobile telephone, which constitutes first communication means, by way of a high pass filter 415.

The transmitter/receiver 108 of the mobile telephone performs radio communications with the ground station connected in the telephone line network in a first frequency band f1, that is, in a frequency band f1*a* of 870 to 890 MHz of received signals, and in a frequency band f1*b* of 920 to 940 MHz of transmitted signals. On the other hand, the radio broadcast received in a radio set 111 using a second frequency band f2, that is, a frequency band f2*a* of 500 to 1620 kHz for AM broadcasts, and a frequency band f2*b* of 76 to 90 HMz for FM broadcasts. Therefore, during the reception of a radio broadcast by radio set 111, if a mobile telephone is used, it is sufficient for the signals in the frequency bands f1*a* and f1*b* during reception and transmission to be inhibited by the band inhibiting filter 413.

The high pass filter 415 operatively disposed between the coaxial cable 105 and the transmitter/receiver 108 of the mobile telephone is connected in series to capacitors C23 and C24. And, a connecting point 417 of these capacitors C23 and C24 is grounded through a coil L23, thereby allowing signals in the frequency band f1 of the mobile telephone to pass thereby and cutting off the signals in the frequency band f2 of the radio broadcasts. Meanwhile, the band inhibiting filter 413 is composed of a first band inhibiting filter 418 for inhibiting the frequency band f1*a* of 870 to 890 MHz, and a second band inhibiting filter 419 for inhibiting the frequency band f1*b* of 920 to 940 MHz.

The first and second band inhibiting filters 418 and 419 are connected in series to the coaxial cable 105, individually. The first band inhibiting filter 418 comprises a coil L25 and a capacitor C25, while the second band inhibiting filter 419 comprises a coil L26 and a capacitor C26. The inductance of coils L25 and L26, and the electrostatic capacity of capacitors C25 and C26 are properly selected so as to inhibit the signals in the above frequency bands f1*a* and f1*b*.

Figure 16:
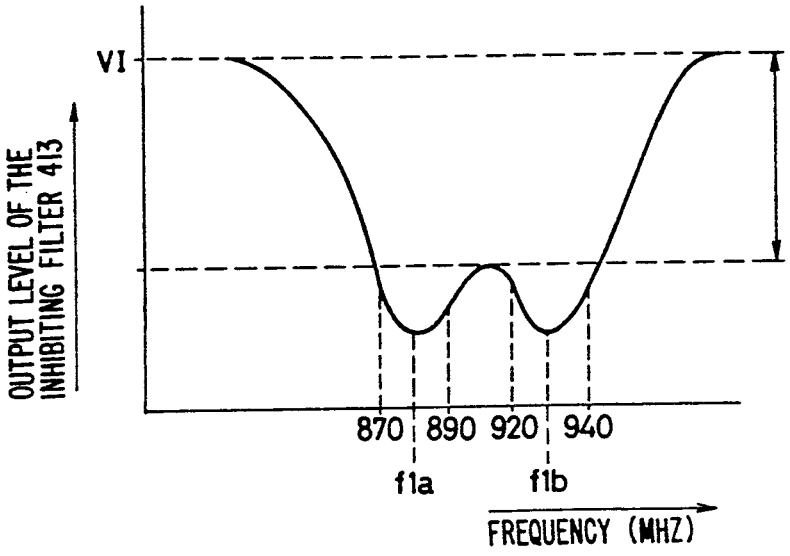
FIG. 16 is a graph showing frequency characteristics of a band inhibiting filter.

FIG. 16 is a graph showing the frequency characteristics of the band inhibiting filter 413. The band inhibiting filter 413 operates during the use of the mobile telephone, and inhibits the transmission of signals from the antenna 103 during a reception mode, and the transmission of signals from the transmitter/receiver 108 of the mobile telephone during a transmission mode. In the radio set 111, generation of noise does not matter if such is at less than 110 dV $\mu$v (+3 dBmW) at input voltage. On the other hand, the transmission output of the transmitter/receiver 108 of the mobile telephone is 5 W (+37 dBmW) in Japan. Therefore, the band inhibiting filter 413 is composed so that the input signal level may be attenuated more than 34 dB and delivered in the frequency bands f1*a* and f1*b* of 870 to 890 MHz and 920 to 940 MHz. FIG. 16 shows the frequency characteristics with respect to the input signal level VI.

Thus, in this embodiment, during use of the mobile telephone, interference of reception signals (870 to 890 MHz) transmitted to the radio set 111 is prevented by the first band inhibiting filter 418, whereas the interference of transmission signals (920 to 940 MHz) transmitted to the radio set 111 is prevented by the second band inhibiting filter 419. In addition, between the signal line of the radio set 111 and the ground there is no intervening electrostatic capacity such that effected by a capacitor so that a drop in voltage level induced by antenna 103 by band inhibiting filter 413 during the reception mode of a radio broadcast will never occur.

In this manner, without lowering the reception signal level of the radio set 111, effects of the transmission and reception signal of for the mobile telephone on the reception of signals of a radio broadcast may be suppressed, and mutual interference between the transmission and reception signals of the antenna commonly used in different frequency bands f1 and f2 may be suppressed.

Figure 17:
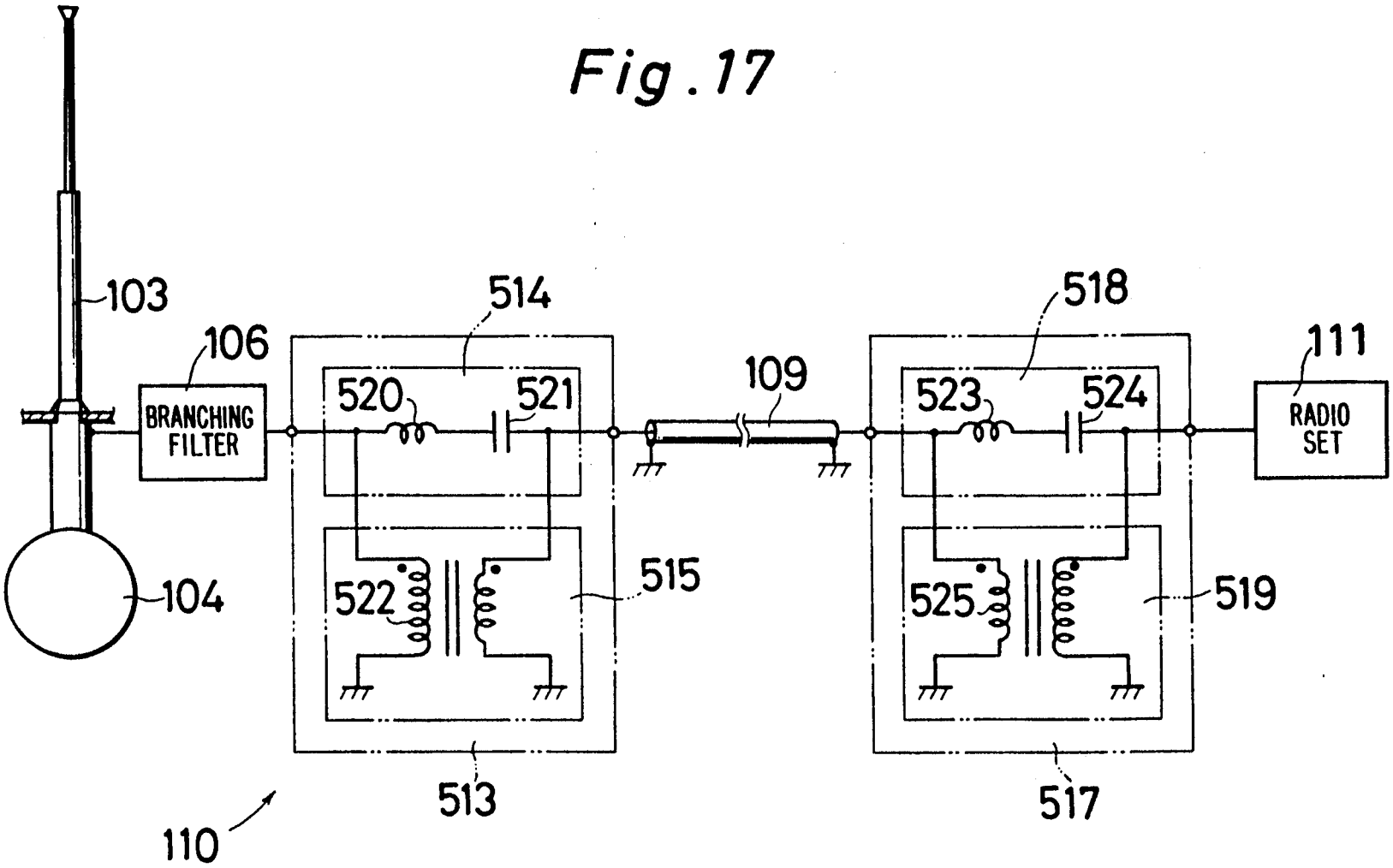
FIG. 17 is a schematic of an embodiment of an antenna circuit according to the present invention.
Figure 18:
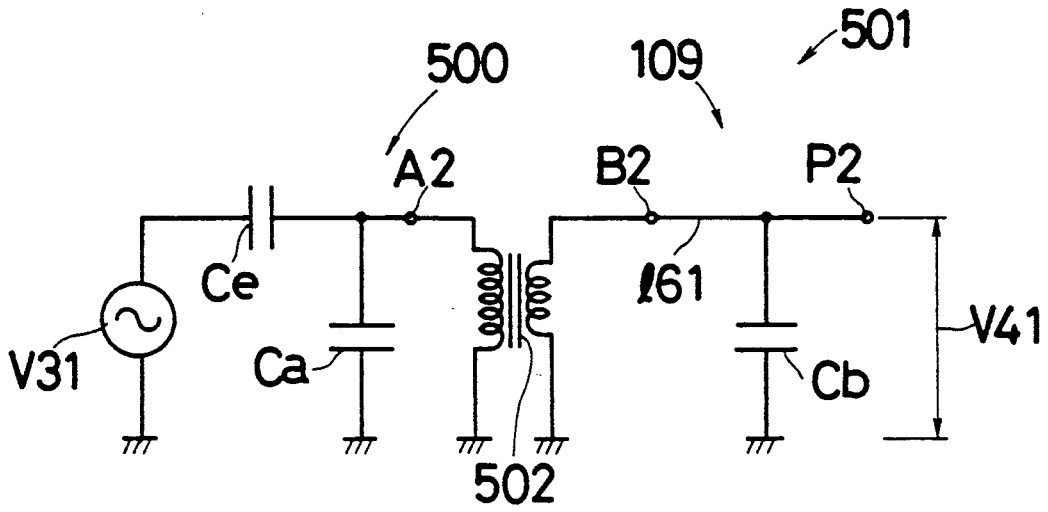
FIG. 18 is an equivalent circuit diagram of an antenna circuit for explaining the principle of the present invention.

FIG. 17 is a schematic of an antenna circuit 110 in a different embodiment of this invention, and FIG. 18 is an equivalent circuit diagram associated with AM radio frequency band f2*a* of an antenna circuit 501 for explaining the principle of this invention. The antenna 500 is represented by an antenna reactive capacity Ca existing against the ground, and an antenna effective capacity Ce existing in series, and an AM radio signal which is a first radio signal received by this antenna 500 is represented as an alternating current power source V31. A coaxial cable 109 is represented by a line 161 between terminals B2 and P2, and this line 161 is grounded by way of a cable capacity Cb. Between the antenna 500 and the coaxial cable 109 is interposed a transformer 502 for converting the impedance. The signal at terminal P2 is transmitted to the antenna input circuit in the radio set 111. The voltage V41 at this terminal P2 is expressed as follows, supposing the ratio the number of turns of the coil at the input side to the output side of the transformer 502 to be H:

$$V41 = \frac{Ce}{Ce + Ca + Cb/n^2} \cdot V31 \tag{6}$$

Figure 7:
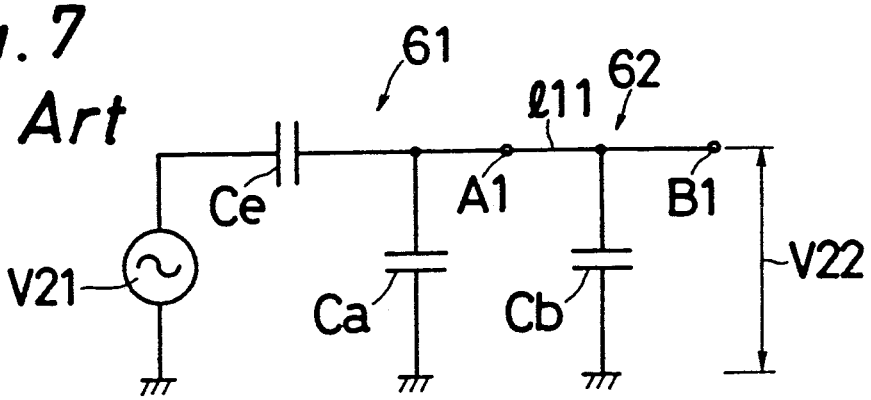
Fig. 7 Prior Art
FIG. 7 is an equivalent circuit diagram in a frequency band of AM broadcast in a conventional antenna 61 and a cable 62.

As understood from eq. 6, by additionally installing the transformer 502, the effect relating to the cable capacity Cb may be reduced in $1/n^2$ of that in the circuit illustrated in FIG. 7. Therefore, the impedance derived from the cable capacity Cb as taken at the terminal A2 is converted to $1/n^2$ by of that the transformer 502 so that the loss at the coaxial cable 109 may be reduced.

The antenna circuit 110 is composed of an antenna 103, the coaxial cable 109, an impedance adjusting circuit 513 interposed between the antenna 103 and the coaxial cable 109, and the impedance adjusting circuit 517 interposed between the coaxial cable 109 and the radio set 111. In FIG. 8, meanwhile, the impedance adjusting circuit 513 is built in the branching filter 106.

The output from the antenna 103 is applied to the impedance adjusting circuit 513 through the branching filter 106. The impedance adjusting circuit 513 has a low impedance in the frequency band f2*b* of FM radio signal, and comprises an FM radio signal filter circuit 514 which constitutes a first filter circuit, conversion circuit 515 which comprises a transformer 522 and constitutes a first impedance conversion circuit connected in parallel to make up the composition. The FM radio signals received by the antenna 103 are delivered to the coaxial cable 109 through FM radio signal filter circuit 514.

The FM radio signal filter circuit 514 is composed, for example, of a series connection of a coil 520 and a capacitor 521, and functions as a high pass filter with a low impedance against FM frequency band f2*b*.

The radio signal from the coaxial cable 109 is transmitted to the impedance adjusting circuit 517. The impedance adjusting circuit 517 is composed of an FM radio signal filter circuit 518 which filters FM radio signals and constitutes a second filter circuit, and an impedance conversion circuit 519 which effects impedance conversion action on AM radio signals and constitutes a second impedance conversion circuit.

The FM radio signal filter circuit 518 is connected in parallel to the impedance conversion circuit 519, and the FM radio signals from the coaxial cable 109 are led out into the antenna input circuit of the radio set 111 through the FM radio signal filter circuit 518. The FM radio signal filter circuit 518 is, for example, composed of a coil 523 and a capacitor 524, and functions as a high pass filter for filtering relatively high frequency signals such as FM radio signals. The impedance conversion circuit 519 comprises a transformer 525 as in the first impedance conversion circuit 522 mentioned above.

Therefore, the inductance of coils 520 and 523 in the FM radio signal filter circuits 514 and 518, and the electrostatic capacity of capacitors 521 and 524 are properly selected so as to possess the resonance frequency in the FM radio signal frequency band, respectively.

Figure 19:
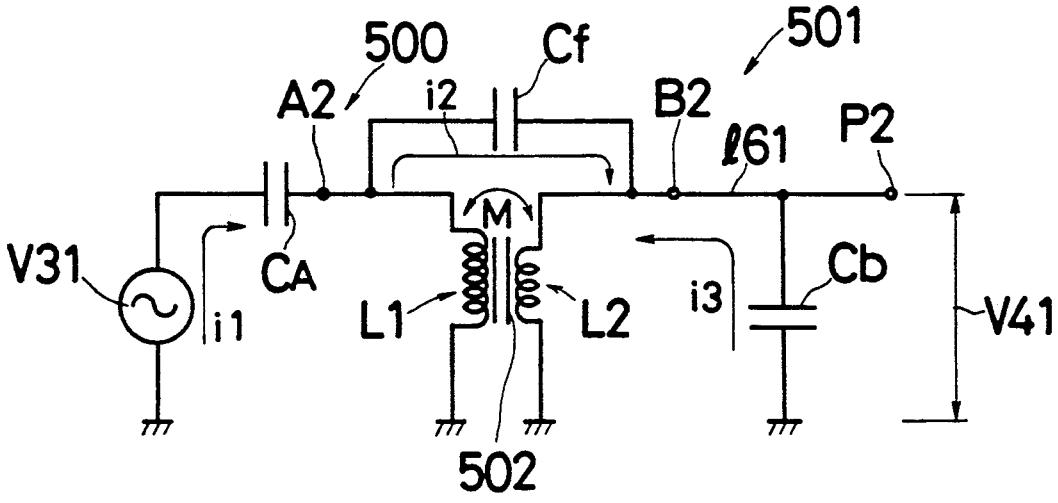
FIG. 19 is an equivalent circuit diagram for explaining the principle under consideration with respect to the capacity Cf in the equivalent circuit shown in FIG. 18.

In the circuit shown in FIG. 18, however, there is actually an effect of the capacity in the FM radio signal filter circuit 514 shown in FIG. 17. An equivalent circuit diagram which illustrates the principle under consideration related to such a capacity component Cf is shown in FIG. 19. For the sake of simplicity, the antenna effective capacity Ce and the antenna reactive capacity Ca are collectively expressed as $C_A$. Incidentally, the transformer 502 corresponds to the transformer 522 in FIG. 17, while the antenna 500 corresponds to the antenna 103. A self-inductance $L_1$ is provided at the input side, a self-inductance $L_2$ is provided at the output side, and there is a mutual inductance M between the input side and the output side. Therefore, between the alternating-current power source V31 derived from the radio signal received by the antenna 500, and the voltage level V41 applied to the radio set 111, the following relation is established, assuming the current from the antenna 500 to be i1, the current flowing in the capacity component Cf to be i2, and the current due to cable capacity Cb to be i3:

$$V31 = \left(\frac{1}{jwC_A} + jwL_1\right)i1 + (jwM - jwL_1)i2 + jwMi3 \tag{7}$$

$$O = jwMi1 + (jwL_2 - jwM)i2 + \left(jwL_2 + \frac{1}{jwCb}\right)i3 \tag{8}$$

$$V31 = \frac{1}{jwC_A}\,i1 + \frac{1}{jwCf}\,i2 - \frac{1}{jwCb}\,i3 \tag{9}$$

And, $$V41 = \frac{1}{jwCb}\,i3 \tag{10}$$

Therefore, solving the above equations, the following relation is established $$V41 = \frac{\{\omega^4 C_A Cf(L_1L_2 - M^2) - \omega^2 C_A M\}V31}{\omega^4(C_ACf + C_ACb + CbCf)(L_1L_2 - M^2) - \omega^2\{L_1(C_A + Cf) + L_2(Cb + Cf) - 2MCf\} + 1} \tag{11}$$

where $\omega$ denotes the angular frequency of the received radio signal.

At this time, when the denominator of eq. 11 is zero, V41 reaches the maximal value. Supposing here that the mutual inductance M is expressed as $k\sqrt{L_1 \cdot L_2}$ (where k is a coupling coefficiency of transformer 502), the maximal value of V41 is expressed as follows:

$$f = \frac{1}{2\pi}\sqrt{\frac{-Y \pm \sqrt{Y^2 - 4XZ}}{2X}} \tag{12}$$

$$\text{where } X = (C_ACf + C_ACb + CbCf)(1 - k^2)L_1L_2 \tag{13}$$

$$Y = -\{L_1(C_A + Cf) + L_2(Cb + Cf) - 2Cf \cdot k\sqrt{L_1L_2}\} \tag{14}$$

$$Z = 1 \tag{15}$$

Figure 20:
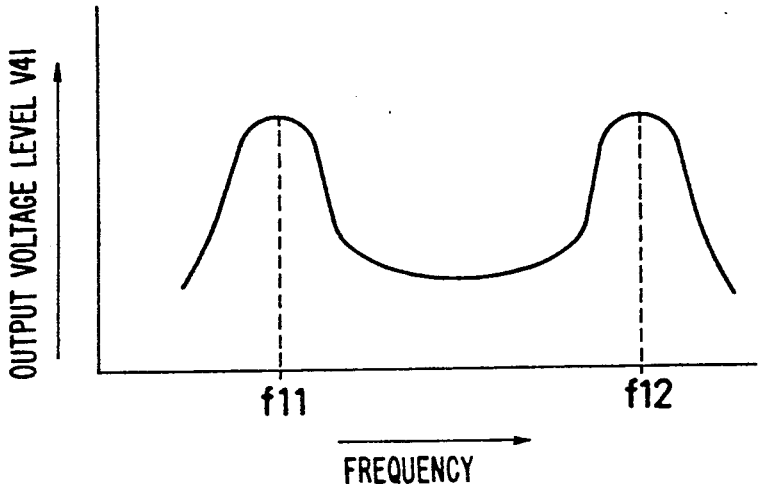
FIG. 20 is a graph showing the relation between reception frequency f and output voltage level V41 in the equivalent circuit shown in FIG. 19.

Thus, as shown in eq. 12, the voltage level V41 comes to possess the maximal value with respect to two values differing in frequency f. Supposing the frequencies corresponding to the maximal value of voltage level V41 to be f11, f12 (f11<f12), the relation between frequency f and voltage level Vc is expressed in FIG. 20. As understood from eq. 12 to eq. 14, as the coupling coefficient k becomes smaller, the frequency f12 becomes lower. Therefore, by increasing the coupling coefficient k possessed by the transformer 502, when the AM radio signal frequency band f2*a* is adjusted to settle within frequency f11 and frequency f12, a flat reception characteristic will be obtained in the AM radio signal frequency band f2*a*. A transformer 502 capable of increasing the coupling coefficient k includes, for example, the so-called sandwich winding or bifilar winding type.

Figure 21:
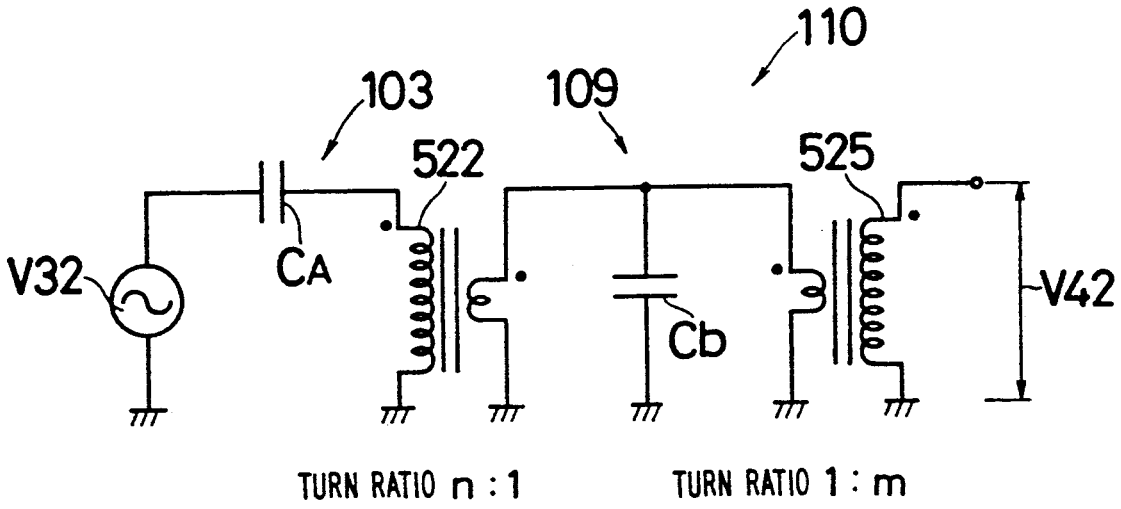
FIG. 21 is an equivalent circuit diagram in an AM radio signal frequency band f2*a* of an antenna circuit.

FIG. 21 is an equivalent circuit diagram in an AM radio signal frequency band f2*a* of the antenna circuit 110 in FIG. 17. The antenna 103 may be represented as a capacity $C_A$ comprising the antenna effective capacity possessing a series electrostatic capacity with respect to the radio signal, and the antenna reactive capacity generated between the radio signal and ground. The radio signal received by antenna 103 may be represented by alternating-current power source V32.

The AM radio signal received by antenna 103 has a high impedance in the FM radio signal filter circuit 514, and therefore are lead into the impedance conversion circuit 515. In the impedance conversion circuit 515, the turn ratio of the number of turns at the input side and the output side of the transformer 522 in n:1. Accordingly, the voltage of the AM radio signal is reduced to 1/n and the impedance is reduced to $1/n^2$ by the transformer 522. The coaxial cable 109 gives rise to a cable capacity Cb between the radio signal and ground.

Relative to a high frequency signal, for example, a FM radio signal, the coaxial cable 109 has a low impedance. However, with respect to a relatively low frequency signal such as an AM radio signal, the impedance of the coaxial cable 109 due to cable capacity Cb is large. In this embodiment, the impedance of the AM radio signal is reduced by the impedance conversion circuit 515, so that the loss relating to cable capacity Cb may be reduced.

The signal in a relatively low frequency band f2*a* such as an AM radio signal from the coaxial cable 109 is high in impedance in the FM radio signal filter circuit 518, and is led to the impedance conversion circuit 519. In the transformer 525 of the impedance conversion circuit 519, the ratio m of the number of turns 1 at the input side to that at the output side is set, and the AM radio signal led to this transformer 525 is amplified in voltage, and is delivered into the antenna input circuit of the radio set 111.

The relation between the alternating-current power source V32 and the output voltage V42 is expressed in the following equation.

$$V42 = V32 \cdot \frac{m}{n} \cdot \frac{C_A}{C_A + Cb/n^2} \tag{16}$$

A capacity $C_{TA}$ of the antenna circuit 110 as seen from the radio set 111 is expressed as follows:

$$C_{TA} = \frac{C_A \cdot n^2 + Cb}{m^2} \tag{17}$$

For example, this capacity $C_{TA}$ is defined at 80 pF in correspondence with the impedance matching with the radio set, and the capacity $C_A$ and the cable capacity Cb are determined by the length of the antenna 103 and the coaxial cable 109. Therefore, the turn ratios n and m of the transformers 522 and 525 are selected so as to satisfy eq. 17 above.

The equivalent circuit of antenna circuit 110 as seen from the radio set 111 may be expressed as the inductance $L_0/2$ and capacity $C_{TA}$ connected in parallel, assuming the inductance at transformers 522 and 526 to be $L_o$. Supposing the resonance frequency of such circuit to be fp, the inductance $L_0$ may be expressed as follows:

$$L_0 = \frac{2}{(2\pi fp)^2 \cdot C_{TA}} \tag{18}$$

It is desired to flatten the frequency characteristics in the AM radio signal frequency band f2*a* by selecting the resonance frequency fp at, for example, 250 kHz or other frequency outside the AM radio signal frequency band f2*a*. Accordingly, the inductance $L_0$ of the transformers 522 and 525 is determined by eq. 18.

Thus, in the antenna circuit 110, for example, when an AM radio signal and a FM radio signal are commonly received by one antenna 103, the loss of the AM radio signal at the coaxial cable 109 may be lowered. For instance, assuming the antenna effective capacity Ce to be 15 pF, the antenna reactive capacity Ca to be 5 pF, the cable capacity Cb to be 120 pF, and the turn ratios n and m to be 4, the gain is improved by about 9 dB as calculated according to eq. 5 and eq. 6.

In the foregoing embodiments, the loss will be greater if too large of a value is set for the turn ratios n and m of the transformers 522 and 525, or the effect will be smaller is too small of a value is used. According to an experiment conducted by the present inventors, favorable results are obtained when a numerical value of 10 or less is selected for the turn ratios n and m.

Figure 22:
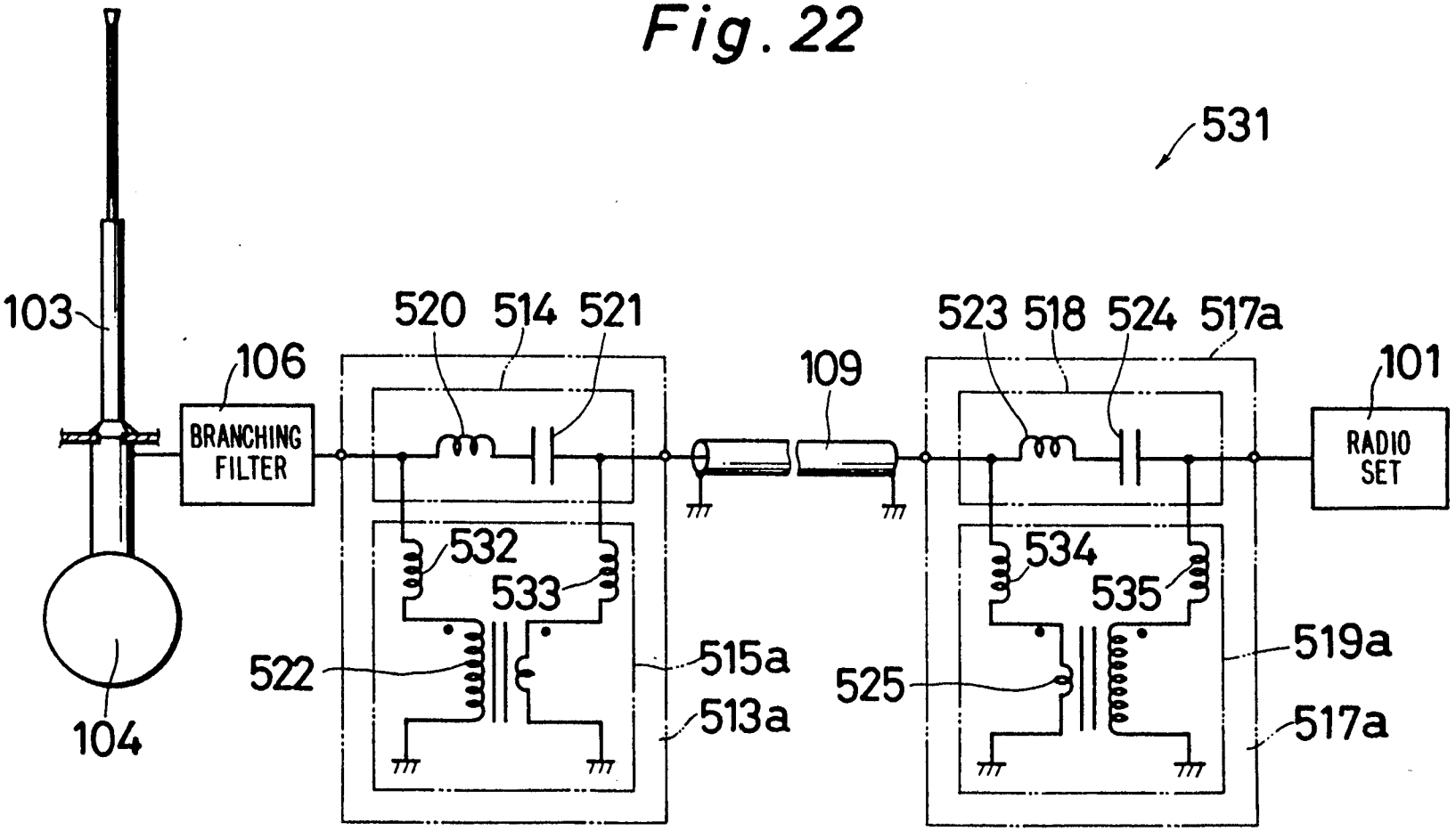
FIG. 22 is a schematic of still a further embodiment of an antenna circuit according to the present invention.

FIG. 22 is a schematic of an antenna circuit 531 in still another embodiment according to the present invention. The parts corresponding to the foregoing antenna circuit 110 are identified with same reference numbers. In the antenna circuit 531, the impedance conversion circuit 515*a* of the impedance adjusting circuit 513*a* comprises coils 532 and 533 and the transformer 522. And in the impedance adjusting circuit 517*a*, the impedance conversion circuit 519*a* comprises coils 534 and 535 and the transformer 525. In order to reduce the loss due to the stray capacity associated with the transformers 522 and 525, coils 532 to 535 are employed at the input end and the output end of the transformers 522 and 525, respectively. As a result, the loss attributable to the stray capacity of the transformers 522 and 525 is prevented, and the reception sensitivity and the S/N ratio may be further enhanced.

In the foregoing embodiments, the loss in the AM radio signal frequency band f2*a* due to stray capacity, in particular, can thus be reduced, while the reception sensitivity and the S/N ratio in the radio receiver may be outstandingly enhanced. Therefore, when receiving signals in a wide frequency band by a single antenna, for example, both FM and AM radio signals are particularly effectively received by a car-mounted antenna constructed according to the present invention.

Besides, depending on the type of antenna in general the antenna reactive capacity varies more significantly than the antenna effective capacity. When this invention is applied to an antenna with a large antenna reactive capacity, its effect will be manifest. Meanwhile, the polarity of the transformers 522 and 525 may be either normal phase or reverse phase, but according to the experiments, greater effect will be obtained when transformers 522 and 525 of a normal phase are used. This embodiment is described with resect to receiving an FM radio signal and an AM radio signal. However, it may be also favorably embodied in applications in which radio signals and other signals such as mobile telephone signals are received at the same time.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced thereby.

What is claimed is:

1. A whip antenna mountable to a car, said whip antenna comprising:

a housing including a first outer tube part comprising electrically conductive material, and a second outer tube part comprising electrically conductive material, said second outer tube part coaxial to said first outer tube part and having a diameter larger than said first outer tube part;

an antenna element telescopically disposed within said housing so as to be extendable from said housing to an extended state and so as to be retractable from said extended state to a retracted state in which the antenna element is disposed in said housing, said antenna element having a first part which projects from said housing when the antenna element is in said extended state, a tubular first lower end part extending directly from a lower end of the first part of said antenna element, having a diameter smaller than that of the first part of said antenna element, disposed within the first outer tube part of said housing when the antenna element is in said extended state, and comprising electrically conductive material, and a tubular second lower end part extending directly from said tubular first lower end part, having a diameter larger than that of said tubular first lower end part, disposed within the second outer tube part of said housing when the antenna element is in said extended state, and comprising electrically conductive material;

an electrically conductive brush disposed over said tubular second lower end part at the outer circumference thereof and in an electrically conductive relationship therewith;

a coaxial cable comprising an electrical conductor and fixed to said housing, said brush contacting the conductor of said coaxial cable at a contact point when the antenna element is in said extended state so as to be in an electrically conductive relationship therewith;

said housing also including a first dielectric interposed between the outer circumference of the tubular first lower end part of said antenna element and the first outer tube part of said housing when the antenna element is in said extended state, and a second dielectric interposed between the outer circumference of the tubular second lower end part of said antenna element and the inner circumference of the second outer tube part of said housing when the antenna element is in said extended state; and the characteristic impedance in that part of the antenna in which the first part of said antenna element is disposed, the characteristic impedance in that part of the antenna located between said first part and said coaxial cable, and the characteristic impedance in that part of the antenna through which said coaxial cable extends being substantially equal when the antenna element is in said extended state.

2. A whip antenna as claimed in claim 1, wherein said first dielectric includes a resin piece disposed over said tubular first lower end part, said resin piece having a diameter equal to that of the first part of said antenna element.

3. A whip antenna as claimed in claim 1, wherein said antenna is capable of commonly transmitting and receiving mobile telephone signals of a wavelength $\lambda 1$ and receiving radio broadcasts of a wavelength $\lambda 2$;

the first part of said antenna element comprises a first conductor extending to the lower end of said first part, said first conductor having a length of $3 \cdot \lambda 1/8$, a phase shifting coil connected to said first conductor at an upper end thereof, said phase shifting coil having an effective wavelength of $\lambda \frac{1}{4}$, a second conductor connected to said phase shifting coil at an upper end thereof, said second conductor having a length of $5 \cdot \lambda 1/8$, a band separating coil connected to said second conductor at an upper end thereof, said band separating coil having an effective wavelength of $\lambda \frac{1}{2}$, and said band separating coil having a high impedance against mobile telephone signals of a wavelength $\lambda 1$ and a lower impedance against radio broadcasts of a wavelength $\lambda 2$, and a third conductor connected to said band separating coil at an upper end thereof, the overall length of said antenna element being $\lambda 2/4$.

* * * * *